US006761353B2

(12) United States Patent
Berman et al.

(10) Patent No.: US 6,761,353 B2
(45) Date of Patent: Jul. 13, 2004

(54) DICE GAME

(76) Inventors: Lyle Berman, 130 Cheshire La., Minnetonka, MN (US) 55305; Naif M. Moore, Jr., 801 Regents Dr. E., Mobile, AL (US) 36609

( * ) Notice: Subject to any disclaimer, the term of this patent is extended or adjusted under 35 U.S.C. 154(b) by 170 days.

(21) Appl. No.: 09/827,647

(22) Filed: Apr. 6, 2001

(65) Prior Publication Data

US 2001/0034264 A1 Oct. 25, 2001

Related U.S. Application Data

(63) Continuation-in-part of application No. 09/246,651, filed on Feb. 8, 1999, now Pat. No. 6,213,876, and a continuation-in-part of application No. 08/831,012, filed on Mar. 19, 1997, now Pat. No. 5,964,463, and a continuation-in-part of application No. 08/572,026, filed on Dec. 14, 1995, now Pat. No. 5,829,748.

(60) Provisional application No. 60/016,256, filed on Apr. 24, 1996, provisional application No. 60/021,073, filed on Mar. 27, 1996, and provisional application No. 60/003,856, filed on Sep. 15, 1995.

(51) Int. Cl.[7] ..... A63B 71/00

(52) U.S. Cl. ..... 273/143; 273/146

(58) Field of Search ..... 273/143 R, 146, 273/274, 138.1, 142 R, 143 A–143 E, 142 A–142 HA; 463/20, 17, 16

(56) References Cited

U.S. PATENT DOCUMENTS 1,573,384 A * 2/1926 Lieske ..... 273/142
5,125,660 A * 6/1992 Stahl ..... 273/146
5,823,874 A * 10/1998 Adams ..... 463/17
5,839,955 A * 11/1998 Mangano et al. ..... 463/16
5,947,820 A * 9/1999 Morro et al. ..... 463/9
6,105,962 A * 8/2000 Malavazos et al. ..... 273/143 R

* cited by examiner

*Primary Examiner*—Benjamin H. Layno

(57) ABSTRACT

A dice game embodied in a table or slot machine format utilizing spinning wheels or slots to generate numbers based multiple repetitions or a count of numbers prior to novel termination and payout events. The preferred embodiment differs from traditional craps in that there is no requirement of a repeated number roll for a win. In one embodiment, a number other than seven, the target number, can be rolled on two six sided dice, numbered on sides from 1–6, in a tournament style fashion over a selected calendar period to win the primary wager. These games include counting the rolls on different players and comparing those rolls and making an award to the player making (a) the most rolls, (b) the most points, (c) the fewest points or rolls or (d) enhanced pay outs for higher targets during a limited (e.g. 4) number of dice rolls. A video layout is disclosed which replaces traditional displays with multiple dice rolls in a novel fashion otherwise consistent with the disclosure herein. A method of generating random numbers using a chute is disclosed as well as a method of determining random results based on mathematical utilization of multiple dice rolls.

14 Claims, 27 Drawing Sheets

| | |
|---|---|
| 2 | 12 |
| 3 | 11 |
| 4 | 10 |
| 5 | 9 |
| 6 | 8 |
| ODD | EVEN |
| HIGH CRAPS | LOW CRAPS |

| | |
|---|---|
| 2 | 12 |
| 3 | 11 |
| 4 | 10 |
| 5 | 9 |
| 6 | 8 |
| ODD | EVEN |
| HIGH CRAPS | LOW CRAPS |

| | |
|---|---|
| 2 | 12 |
| 3 | 11 |
| 4 | 10 |
| 5 | 9 |
| 6 | 8 |
| ODD | EVEN |
| HIGH CRAPS | LOW CRAPS |

FIGURE8a

ALL PLAY BASED ON 4-WHEEL SPIN

DICE GAME

This is a continuation in part of the provisional patents by the same inventor filed as case: Serial Nos. 60/003,856 filed Sep. 15, 1995, 08/572,026 filed Dec. 14, 1995 now U.S. Pat. No. 5,829,748, 60/016,256 filed Apr. 24, 1996, 60/021,073 filed Mar. 27, 1996, 08/831,012 filed Mar. 19, 1997, now U.S. Pat. No. 5,964,463, and continuation in part divisional Ser. No. 09/246,651 filed Feb. 8, 1999, now U.S. Pat. No. 6,213,876, by N. M. Moore, Jr.

This game has been, in part, previously disclosed in patent applications cited above.

BACKGROUND OF INVENTION

The invention relates generally to dice games utilizing two sets of dice generating numbers between two and twelve and games where a repetitive number of determinations in a series.

GENERAL DESCRIPTION OF THE INVENTION

Structure of the Table

The invention described herein may be used on a traditional craps table or on a Four The Money Table.

The size of the table in a sit down version using a chute as described below, may be 7×3½ feet, and is shaped similar to a blackjack table as shown in FIG. 2. Built in, is a computerized electronic controlled board designed to light up certain embodiments. These lit embodiments will be covered by a plexiglass top to protect the electronic lighted areas of this table.

The table has player locations 33 which allow the player to maintain all odds bets locations 5–14, for the money bets and some 'side bets' such as Forty O'Lordy 4 and all or nothing locations 3.

The Chute (FIGS. 4*a*, 4*b* and 4*c*) is provided, particularly in a sit down version to insure a good roll of the dice.

Four the Money Game

This particular game is largely disclosed in the prior filing. An electrical display system is preferably incorporated into the table or attached to the table in an urn 45. The dealer will enter the Start of Roll and each roll (die by die) and the appropriate display lights will advise players and the dealer of awards to be made and bets to be swept.

Aside from traditional craps, several games generally disclosing the roll of dice in obtaining winning combinations exist. The preferred embodiment may have a target event (such as a 6 and an 8 being rolled), usually a single target number (in the preferred embodiment a seven (7)), and allowing for a win when any number of rolls over a specified minimum number, preferably four (4), are made without generating the target event (rolling the target number, seven). Certain numbers may be excluded in determining the specified minimum number. Side games, all based on avoidance or attainment of a number of rolls or certain rolls during the period between the initial roll and the target roll may be made. These may be similar to those wagers available in traditional dice games based around either one roll or two rolls of a single number prior to rolling a seven.

Winning is tied to having a significant number of dice rolls sequentially.

For example, a traditional craps roll will end or reach a termination event when a come out point 4–6 or 8–10, followed by a 7 before repeating the come out point.

Four the money also counts four rolls before a seven as the basis of winning in the preferred embodiment. Similarly, in other embodiments the number of rolls before a six (6) and eight (8) (a target event using two target numbers) could be the method of determining when a win occurs.

Peat and Repeat, Different Doubles, and normal place bets along with the other disclosure below reflect methods of practicing side bets.

In order to determine the relative odds for a payout and in order to determine what is a fair number of rolls necessary in order to justify a win, statistics are applied to the probability of rolling multiple times before a target is rolled. For example, you could have four rolls prior to the roll of a seven or five rolls prior to the roll of a six or eight without leaving the basic embodiment of the game.

Under the terms of Four the Money Wager, only multiple rolls prior to the roll of a seven results in a payout.

"Four the Money™"

To qualify as a shooter a player has the mandatory obligation of making a minimum "FOUR THE MONEY WAGER". In traditional craps, to qualify as a shooter, a pass or don't pass bet must be made. For non-shooters there is no obligation, this bet is optional. If a player chooses not to make a "FOUR THE MONEY WAGER" or come out on traditional craps, true odds will not be allowed.

The amount wagered on either of these features is optional as long as it is within the minimum and maximum allowed by each casino. The true odds allowed will be based solely on this wager. If a non-shooter chooses not to make this bet they still qualify for play on all features other than true odds.

"FOUR THE MONEY" wagers are placed on circles in front of each player. All bets on this feature must be placed before the first roll or after every fourth roll thereafter. To win a "FOUR THE MONEY WAGER" the shooter must roll the dice four times without a seven appearing. If a seven does appear within the four rolls all "FOUR THE MONEY" wagers lose. All other numbers that can appear other than a seven, are available for "FOUR THE MONEY WAGER" players to take true odds including odd or even roll bets.

The numbers rolled on the dice each time are keyed into a keyboard by the dealer. This action displays the number rolled as well as the number of rolls made by each shooter.

Mathematical Analysis

"FOUR THE MONEY WAGER™" requires that four consecutive rolls be made without a seven appearing. This wager is paid out at even money (1-1). Since the probability of winning is 0.4822 the house advantage is 3.55%. Players must wager on this feature prior to the shooter's first of every four rolls.

True odds can be taken when the "FOUR THE MONEY WAGER" is bet before the initial roll and to be changed with each successive role as described in the original specification and under the direct control of the player (i.e. the player places his odds wagers himself on a location provided therefor before him).

True Odds

In order to make the video game more interactive and induce players to increase the amount wagered, any player who bets on "FOUR THE MONEY" is entitled to play the TRUE ODDS bets on individual numbers from 2 through 12 and odd or even. To win, the selected numbers must be rolled before a "7". The pay outs are:

6-1 on 2 and 12, 3-1 on 3 and 11, 2-1 on 4 and 10, 3-2 on 5 and 9, 6-5 on 6 and 8.

Since these are at true odds, the house has no advantage in them. They serve as an incentive for players to play "FOUR THE MONEY WAGER™" If a player lays or takes 10 times odds, the house advantage of the combined "FOUR THE MONEY WAGER™" and ODDS bets is reduced to 0.32% of the total at stake.

Odd or Even Number Roll™

There are thirty six possible combinations that can be rolled with two dice. Eighteen of these combinations are 3-5-7-9-11 while eighteen are 2-4-6-8-10-12. Therefore, it is an even money bet as to whether the number that is rolled with two dice is an odd or even number. Since true odds are offered with this feature there is no house advantage. Bets made on this feature are counted as the true odds allowed. A bet must be made on the "FOUR THE MONEY WAGER™" or come out roll in traditional craps, in order to place a wager on odd or even number roll.

How to Play

One of the unique features offered is "FOUR THE MONEY™" wagers can bet odd, even or choose any or all numbers 2 through 12 (no seven) to take true odds before making any roll including the first. These odds wagers can be taken in any mixture the player chooses as long as the total on all odds wager does not exceed the amount of odds allowed. The odds allowed will be based on a multiple of each player's "FOUR THE MONEY WAGER™". If a non-shooter does not make a "FOUR THE MONEY WAGER™" these true odds are not available.

Each "FOUR THE MONEY™" player places their own odds on the designated numbers in front of them. After each roll the dealer will give players ample time to rearrange or take down their true odds to their liking. As true odds are paid there is no house advantage on the odds allowed.

Forty O'Lordy™

To place an "Forty O'Lordy™" wager, the wager must be bet before the first roll of each shooter. The winning or losing of this wager is based solely on a player's ability to generate 40 rolls prior to a seven appearing. A 4×4 inch electronic light will record the number of rolls made by each shooter prior to a seven appearing.

Mathematical Analysis of Forty O'Lordy

This bet pays off if the shooter rolls a pair of dice forty times without a seven appearing. Players must bet on this feature before each shooter's first roll. The payout for this feature is 1200 for 1. The true odds are 1,468-1, resulting in a house advantage of 18.3%.

Over Seven

All players can bet on this feature prior to any roll. To win, both dice must total 8, 9, 10, 11 or 12. This is a total of fifteen of the thirty-six combinations that can be rolled. The true odds against wining this feature are 7 to 5 the payoff is 6 to 5 leaving the house a 8.4% advantage. There are fifteen winning and twenty-one losing combinations.

Under Seven

All players can bet on this feature prior to any roll. To win, both dice must total 2, 3, 4, 5 and 6. This is a total of fifteen of the thirty-six combinations that can be rolled. The true odds against wining this feature are 7 to 5 the payoff is 6 to 5 leaving the house a 8.4% advantage. There are fifteen winning and twenty-one losing combinations.

Seven

There are six combinations on two dice that will make a seven and thirty that will not. Thus the true odds against rolling a seven in any given roll is five to one. This feature pays four to one leaving the house with a 16.67% advantage.

High Low Craps:

In another embodiment, known by the trademark High-Low Craps, disclosed in this specification, a decision event is the completion of four rolls which mandates a decision based on the tally of the numbers shown on the dice. The first terminates each play by a single roller and is based on a specific (four) number of dice rolls. The termination event occurs when the player has bet that the total number value of the dice during the decision is within a first range and the value then falls within a second, different range. An example of this range is above 28, below 28, or equal to 28. An alternative would be to have one range be odd and one range be even as shown in FIG. 8.

A randomizing method is taught. The method involves the use of two sets of dice means (random number generators) in a game with rules to generate a random payout for a video game. The specific technology may be applied to the particular game described above for this purpose.

Improvements disclosed in whole and in part include a game generating one or more random numbers including a means for displaying each of the random numbers generated and may also include a special display for the last of the numbers rolled, and the number of repeated number rolls. Since four rolls are used for a decision event, the video display would show these four rolls.

Under this scenario of the game, there is no limit on the number of points that can be recorded to determine a winning jackpot wager.

It is therefore an object of this invention to provide for a dice game allowing for continuous play centered around adding accumulated points which does not require a repetitive roll of a given number for winning or losing the primary wager.

It is another object of the game to provide for a dice game allowing for true odds to be taken prior to the first roll.

It is another object of the invention to provide a game having added excitement for all players by having payout based on statistically remote outcomes.

It is a further object of the invention to provide for a dice game having a jackpot payout based on a predetermined number of points made during a predetermined period of time.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 6 is an alternate embodiment of the video incorporating the High Roller of the Month feature.

DETAILED DESCRIPTION OF THE PREFERRED EMBODIMENT

I. "Four the Money Wager"™ Game

Figure 1:
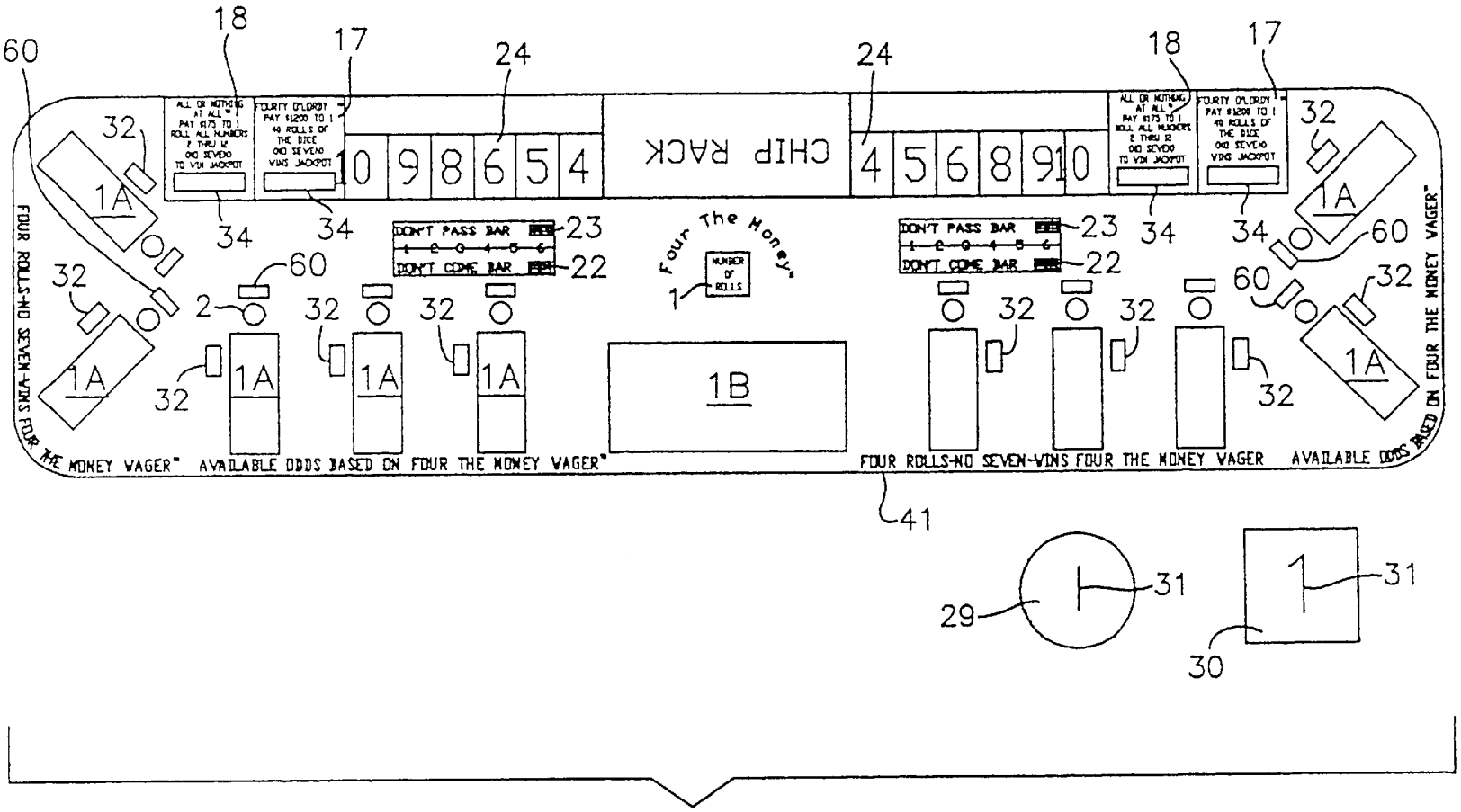
FIG. 1 is a plan view the invention showing the preferred embodiment of Four The Money.
Figure 1A:
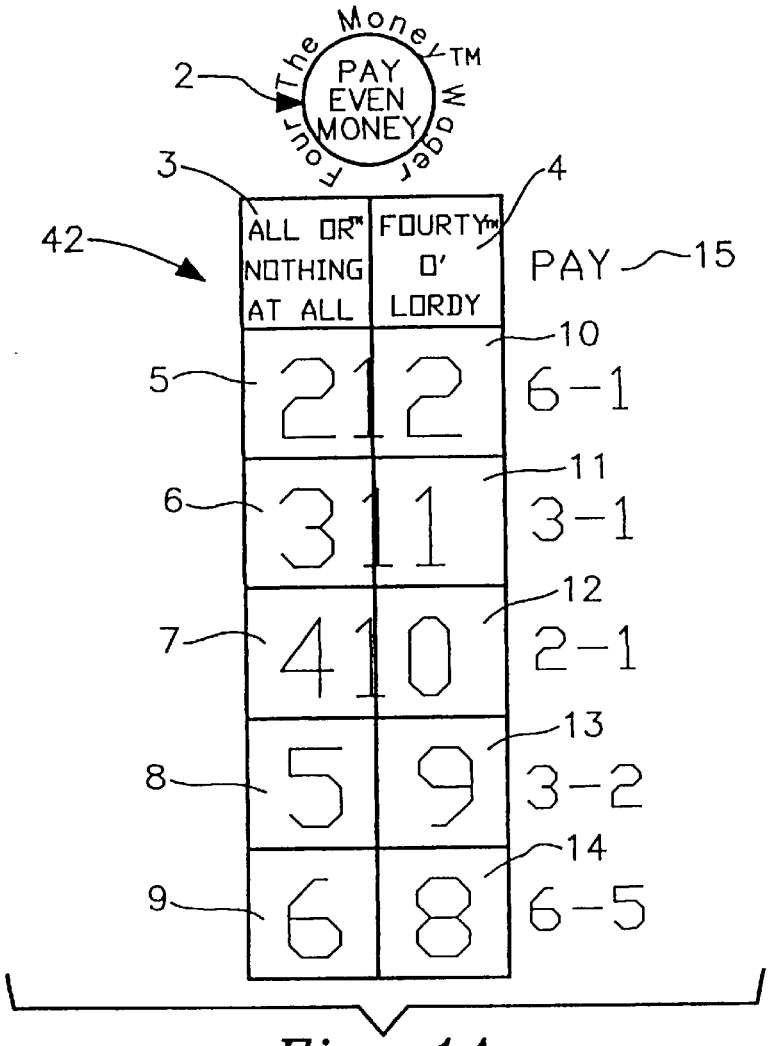
Figure 1B:
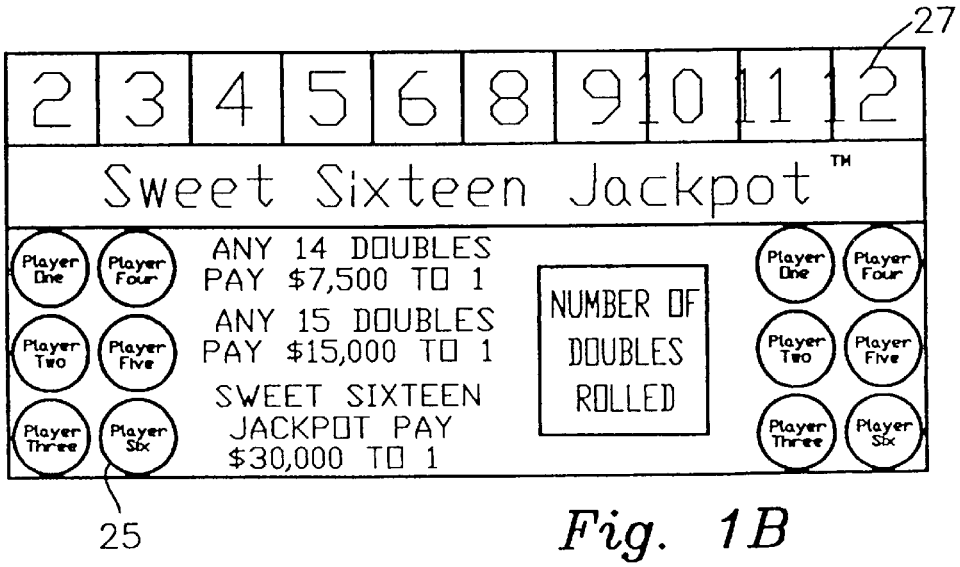
Figure 2:
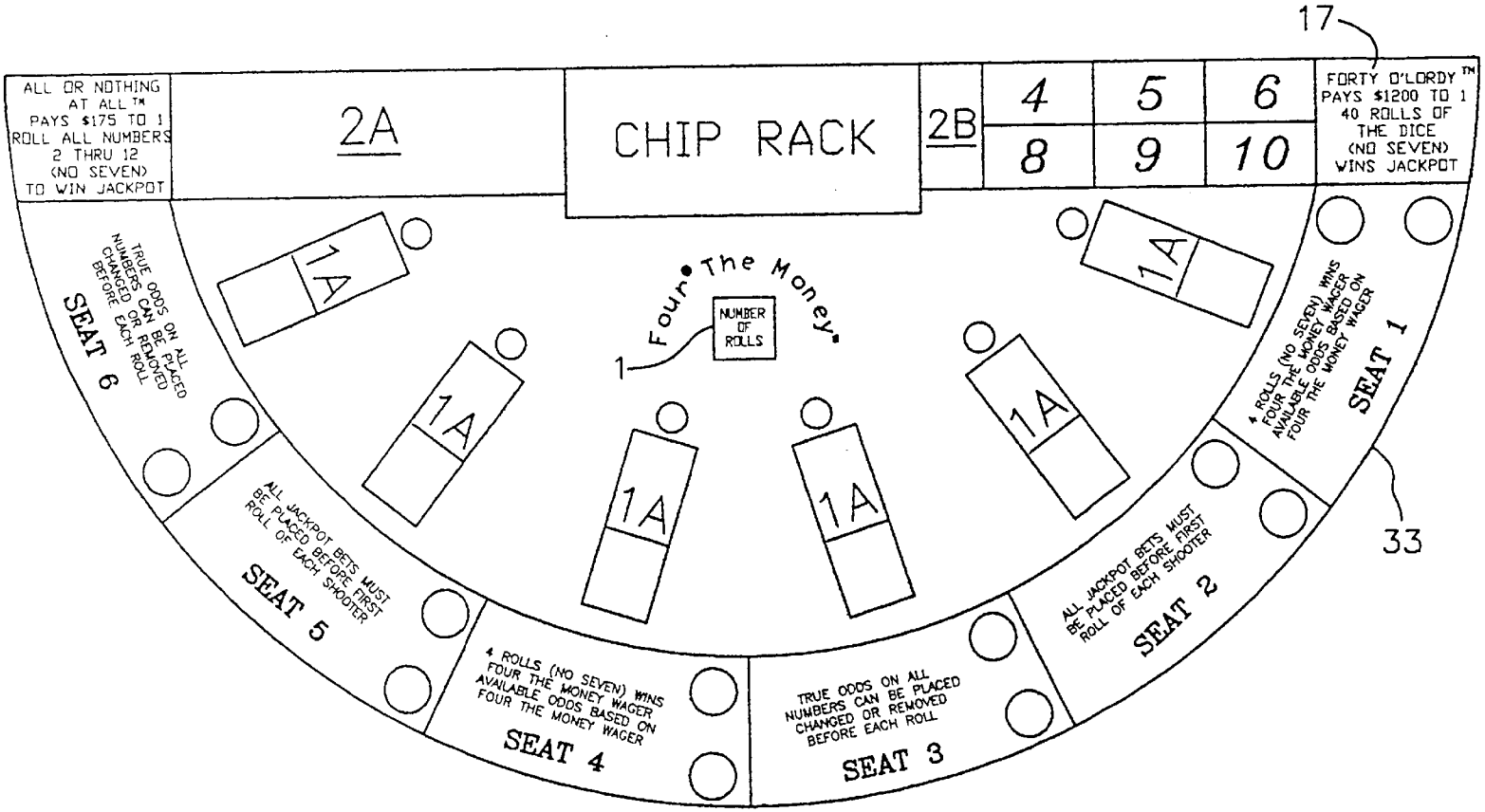
FIG. 2 is an alternate embodiment of the invention shown in FIG. 1.
Figure 2B:
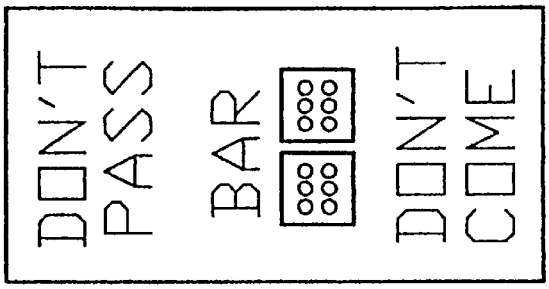
Figure 2A:
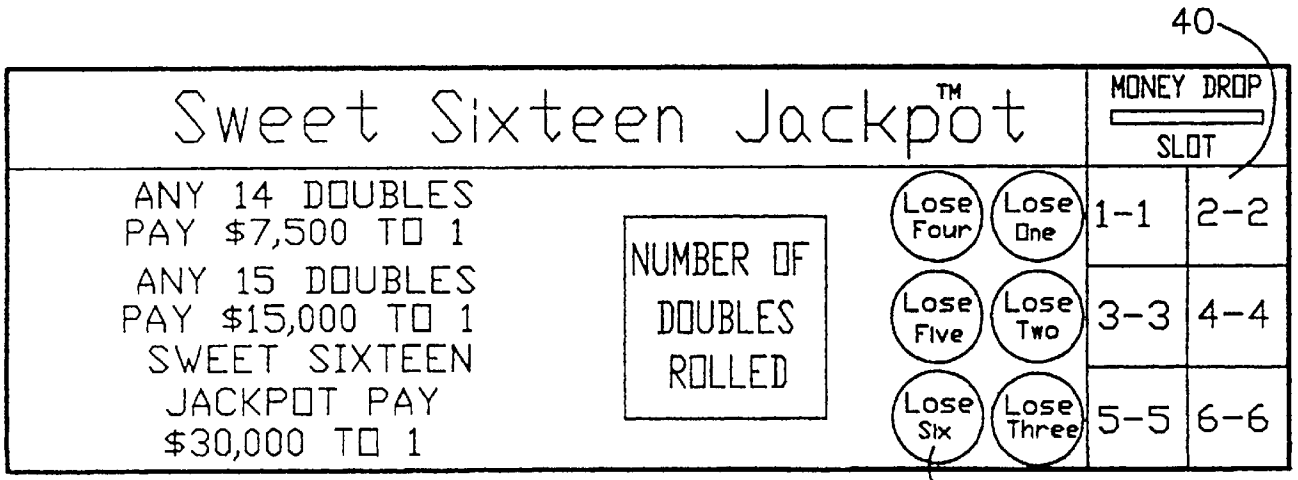

As can best be seen by reference to FIG. 1 and FIG. 2, the game may be played in a table top version. The preferred embodiment shown in FIG. 3 uses a video layout. Like wager locations on these three embodiments are similarly marked. Play is initiated by generating a random number between a preset minimum and a preset maximum. This is done in the preferred embodiment with traditional two six sided dice analysis. Two random numbers are therefore generated between one and six and totaled to determine the value of the number generated giving rise to various odds based on the percentage possibility of any given combination.

In the preferred embodiment, there is a target number 20 (not shown) selected as the number seven since it is the most likely number. A target of a different number or multiple different numbers, for example six and eight, could also be selected within the disclosure embodied herein. Under such circumstances, the payout odds would need to be modified according to the relative probability of these multiple target numbers being generated prior to the consecutive number described in more detail below being reached.

A money location 2 for a "FOUR THE MONEY WAGER" is provided for the initial even money bet that has to be made to qualify a player to play true odds bets in each new round of the game "FOUR THE MONEY"™. A counter display 1 is provided to show how many consecutive rolls are made prior to encountering the target number 20 (not shown).

The winning or losing of a money wager placed on the money location 2 is based solely on whether or not a seven, the target number, appears within a consecutive number of rolls, in the preferred embodiment four rolls. This determination is not influenced by any other action or bets on the table. A money wager is made on the money location 2, a random number is generated, typically by rolling the dice, and a win occurs if the random number generator or 'shooter' rolls the dice four times, thereby reaching the consecutive number of rolls equal to four, without a seven appearing. If a seven does appear on the 1st, 2nd, 3rd or 4th roll all money wagers made on the money location are lost.

If the shooter rolls the dice all four times without a seven appearing all money wagers made on money locations automatically win.

All other numbers (2, 3, 4, 5, 6, 8, 9, 10, 11, 12) that can appear on a pair of dice, shown as odds bets 3–14 (all numbers except seven), may apply towards the task of making four rolls of the dice without a seven showing. The minimum actual value of a dice roll possible is two. The maximum number possible is 12. Similarly, only some of these numbers may apply to making the consecutive number. For example, 2 and 12 could not be counted in one embodiment in arriving at the consecutive number. The remaining numbers, 3–6 and 8–11, would be the count numbers.

As each successive roll of the dice is made the number displayed on the counter display 1 increases from zero upward. A maximum number of rolls, for example 99, may be assigned in order to avoid a situation where a statistically remote event would otherwise allow for indefinite play. In the preferred embodiment this maximum number is forty. When this maximum consecutive number is reached, all wagers would be paid and the counter 1 would be reset to zero. In the preferred embodiment, the maximum consecutive number would be forty.

A money wager typically would pay even money. The true odds of a seven appearing in four in the preferred embodiment are 1.0736 to 1. The percent of profit to the house under this scenario is 3.55%.

A money wager on the money location 2 is the initial even money bet that has to be made to qualify a player to participate in odds bet.

The winning or losing of this wager is based solely on whether or not a seven appears within four rolls and is not influenced by any other action of bets on the table. To win this wager the shooter rolls the dice four times without a seven appearing. If a seven does appear on the 1st, 2nd, 3rd or 4th roll all "FOUR THE MONEY WAGERS"™ Lose. The wagers placed on the money location 2 are removed and kept for the house. If the shooter rolls the dice all four times without a seven appearing all "FOUR THE MONEY WAGERS"™ automatically win and payout are made on the money location 2.

In the preferred embodiment there is a table which has at least one money wager. In the preferred embodiment a bet is placed on this money location to bet on four rolls in a row. A separate money wager may be provided for bets where it required five rolls in a row in order to win.

It could be determined whether or not a payout would occur on the come out rolls either with the rolling of a seven or eleven or whether there would be no payout on these unless there was a four in a row roll for the four in a row come out bet.

A "FOUR THE MONEY WAGER"™ pays even money. The true odds of a seven appearing in four are 1.0736 to 1.

Odds Bets

The game also incorporates true odds bets wherein a bet is placed on a number. These are not standard place bets or odds bets as used in craps based on the statistical significance of a single number being rolled prior to a seven being rolled. One improvement of this game over traditional craps is that odds bets may be made in conjunction with a money wager before a 'point' or number bet is made. This is because repetitions of a single number are not required, only multiple occurrences of any number other than the target number in order to win the initial "FOUR THE MONEY WAGER" on the money location 2.

The odds bets are based on a multiple (1 upward) of the amount placed on the "FOUR THE MONEY WAGER". Hence a table providing for five times odds would allow a twenty five dollar odds wager on an odds location 5–14 where a five dollar wager was made on the money location 2.

This element of uniqueness of this game allows any player to take true odds on all the odds numbers before making their first roll. These true odds bets are made on the odds locations 5–14. If a number other than seven is rolled, the dealer pays out next to the place location corresponding to the number rolled.

The odds are shown in the odds column 15 next to each set of place bets. Hence, if a place bet is made on the place location 5 or 10 corresponding to a dice roll of two (or twelve) and a two (or twelve) is rolled, a payout of six to one is made. That is six dollars would be paid for each one dollar wagered on the two location 5 (or twelve location 10). If a seven is rolled before the rolling of the odds location number 5–14, the odds location wager would be lost and removed by the 'house'.

The odds shown on the pay line 15 are shown on the following table:

| | |
|---|---|
| 2 AND 12 PAY 6 TO 1 | TRUE ODDS 6 TO 1 |
| 3 AND 11 PAY 3 TO 1 | TRUE ODDS 3 TO 1 |
| 4 AND 10 PAY 2 TO 1 | TRUE ODDS 2 TO 1 |
| 5 AND 9 PAY 3 TO 2 | TRUE ODDS 3 TO 2 |
| 6 AND 8 PAY 6 TO 5 | TRUE ODDS 6 TO 5 |

On the table, place locations 5–14 group these numbers together according to the respective odds of making a given bet.

Place bets for the other numbers could also be provided which would play true odds for each of those numbers obtained. This way the subject game could be incorporated completely or in part with a pre-existing craps game.

Forty O'Lordy™

Another feature in the game is the progressive betting associated with successive rolls after the first four without a seven. Successively higher payout or progressive payout may be made as multiples higher than four are made. One method of accomplishing this is to have a payout if forty rolls are encountered without a seven. A Forty wager, in the preferred embodiment, yields a 1200 to one payout as shown in the forty display 17 shown on FIG. 1. Chips indicating how many rolls have been made (one chip for each roll, for example) may be placed on this location to supplement the numeric display 1.

The winning or losing of this Wager is based solely on the number of rolls made prior to a seven appearing. Players may be given a choice of betting on 10, 20, 30 or 40 rolls prior to a seven appearing.

In the preferred embodiment a 4×4" electronic light 1 will record the number of rolls made by each shooter prior to a seven appearing. Another example of how this can be done would be:

| | | |
|---|---|---|
| (1) 10 ROLLS NO SEVEN | PAY 5 FOR 1 | TRUE ODDS 5.9 TO 1 |
| (2) 20 ROLLS NO SEVEN | PAY 30 FOR 1 | TRUE ODDS 37.3 TO 1 |
| (3) 30 ROLLS NO SEVEN | PAY 200 FOR 1 | TRUE ODDS 236.3 TO 1 |
| (4) 40 ROLLS NO SEVEN | PAY 1200 FOR 1 | TRUE ODDS 1468 TO 1 |

Obviously, this can also be done in multiples of 1, 2, 3, 4, etc. without departing from the inventive concept herein. These exemplary methods are shown for purposes of teaching the invention embodied herein.

Similarly, successively larger pay outs on money wagers may be placed at successive rolls to build excitement. For example, after ten rolls, each for the money payout may payout at a higher yield, such as 1.5 to one. In this example, at 12 rolls, instead of a dollar for dollar payout there would be a dollar and fifty cents for each dollar on the money location 2. This could hold for all the following "FOUR THE MONEY WAGERS" or terminate or increase again. This would prevent players from coming in except on the don't pass after the first four rolls, however, and is not shown on the preferred embodiment.

Similarly, this particular provision could be allowed only with the payment of a successive wager accepted at the beginning of each roll. In this manner, at the beginning of each round (after a target seven was generated are the first time the game is played) a player would place a successive wager. This successive wager could entitle the player to jackpots or to the successively higher pay outs. Other players joining in later in the roll could not participate in the successively higher payout.

One method of practicing a jackpot or successive wager proposition only available on the initiation of a game would be to provide a slot 32 for payment beside a particular player's for the money wager. If a payment was made into this slot prior to the initial roll, a light could be displayed under the money location 2 (or at any other suitable location) showing this player was entitled to either jackpots, successively higher pay outs or both. One jackpot wager slot could be provided for the jackpot and a second successive wager slot could be provided for successively higher pay outs. At least one slot 32 on a table top version is provided for each player location 33. A jackpot display 34 may be placed at any location on or above the table for any of the jackpots described herein.

Don't Come Don't Pass Bets

Don't pass bet locations 23 and don't come bet locations 22 are provided for two purposes. First, it allows players to come into the table after the initial "FOUR THE MONEY WAGER" is made where multiple rolls provide enhanced payout. Second, it allows system players to play system bets. A tracking location 24 is provided in order to allow for the player's bets to be held by the house and paid according to generally accepted gambling practices.

These bets work in the same fashion that don't come and don't pass bets work with traditional craps.

As can be seen the don't bet tracking location 24 is numbered from 4 to 6 and 8 to 10. This is because all other traditional don't pass bets are either losers, ties or winners.

The odds may be the same on don't come, can't pass bets as are provided on odds bets on the odds locations 5–14 on the money wager made on the money location 2.

High Roller of the Month

To practice High Roller of the Month on a traditional craps table the modifications necessary would be to predetermine the number of rolls necessary to win prior to the termination event of a roll (known in the art as "seven out") and provide a counter and a payout based on dice rolls for qualifiers.

1) An electronic keyboard and a counter 1 in FIGS. 1 and 2 would be added to monitor the number of points or rolls. With each participating shooter, the box man will activate system. If a shooter chooses not to participate, the box man does not activate keyboard. Each time the keyboard is activated, money is added to the jackpot.

This is a jackpot which in the preferred embodiment is paid monthly, but may be paid weekly, yearly, etc. Similarly, several tables or even different casinos may be tied in together to increase the jackpot. In the monthly embodiment, the jackpot begins the first minute of the first day and ends on the last minute of the last day of each month.

To participate,

1) The Shooter pays one dollar, which is added to jackpot.
2) If shooter chooses not to participate, keyboard does not activate the counter.
3) The qualifying score must be recorded in shooter's name.
4) Multiple craps tables within each casino can be tied together with one mutual jackpot.
5) No matter when a shooter qualifies, they participate in all monies accumulated during month.
6) A qualifying event may be necessary to qualify as a winner:

At a four the money table, a shooter may have to hit a certain number of cycles in the preferred embodiment. In the preferred embodiment, the shooter must make forty points on a traditional craps table to qualify. A payout based on the Forty O'Lordy wager discussed herein may be tied to this achievement. On a traditional craps table, this 40 rolls would be the scoring of 40 points in the preferred embodiment and would include 7's rolled on the 'come out' roll.

An alternative would be to have the qualifiers roll a certain total tally over the course of a standard craps roll. For example, rolling a six, an eight, a six, a seven, a five and a seven would yield a total tally of either 32 or 39 depending on whether the last seven were counted or not. A tally of 300 points is set in the preferred embodiment. A jackpot similar to the Forty O'Lordy jackpot in amount, based on the odds of reaching this number would be paid upon reaching this tally.

7) All qualifying shooters are winners.
8) Names and score of all qualifying participants may posted with casino.
9) The leader's name and score may be individualized.
10) If no shooters qualify, jackpot may be rolled over to the next month.
11) A person's name and score can be registered only once. If a shooter exceeds their previous qualifying score, only the highest qualifying score is valid.
12) In one embodiment 100% of all money accumulated goes into the jackpot. In another embodiment, a percentage of this payment goes to fund the Forty O'Lordy wager.
13) Each month's contest begins at 12:01 on the first day of each month and ends at midnight on the last day of each month.

An alternative embodiment would provide that any people at the table could wager on any Shooter's roll. The jackpot would then be split between the players who wagered on the particular Shooter's roll. This would function in the same way as the shooter's wager but would allow other players to participate in a high roller's shot at a jackpot. This would encourage friends to wager on another friend's high roller wager. A high wager location 60 for the high roller wager is provided in FIG. 1.

In this, Four the Money embodiment, there could be a playoff or roll off for all rollers who scored 40 or more rolls and decided to participate in the playoff for the jackpot.

In another embodiment, there would be pay outs to all qualifier or at least the top three. One method of this division would be:

30% bonus to 1st place winner

20% bonus to 2nd place winner

10% bonus to 3rd place winner

The balance of money could be equally divided between all qualifying shooters, including the first, second and third place winners.

In order to compensate casinos for cost of operation, it might be determined a certain percentage of jackpot money might go toward that cost.

This is discussed in more detail below.

High Low Craps

Figures 5, 5A:
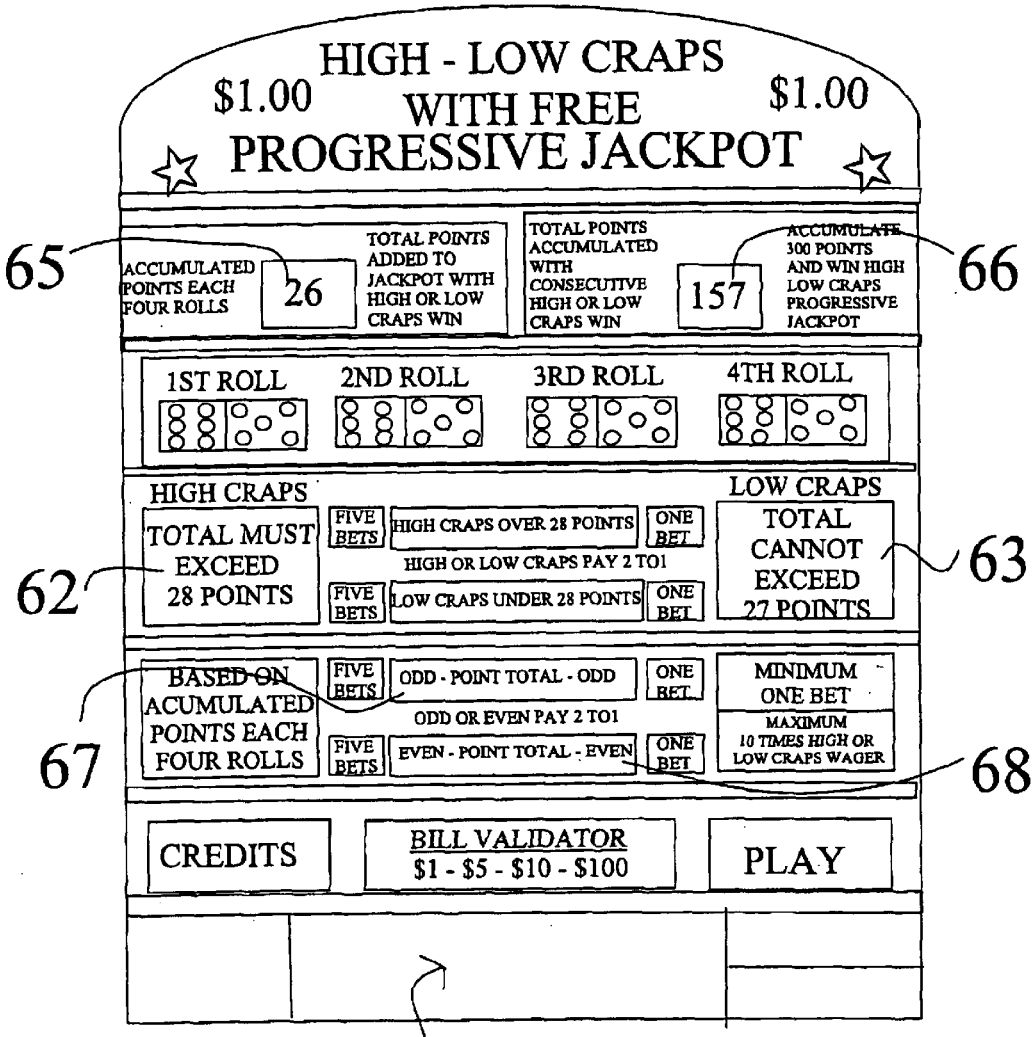
FIG. 5 is an embodiment of the video layout of High-Low Craps.
FIG. 5*a* is a detail view of item "FIG. 5*a*" shown in FIG. 5.
Figure 5A:
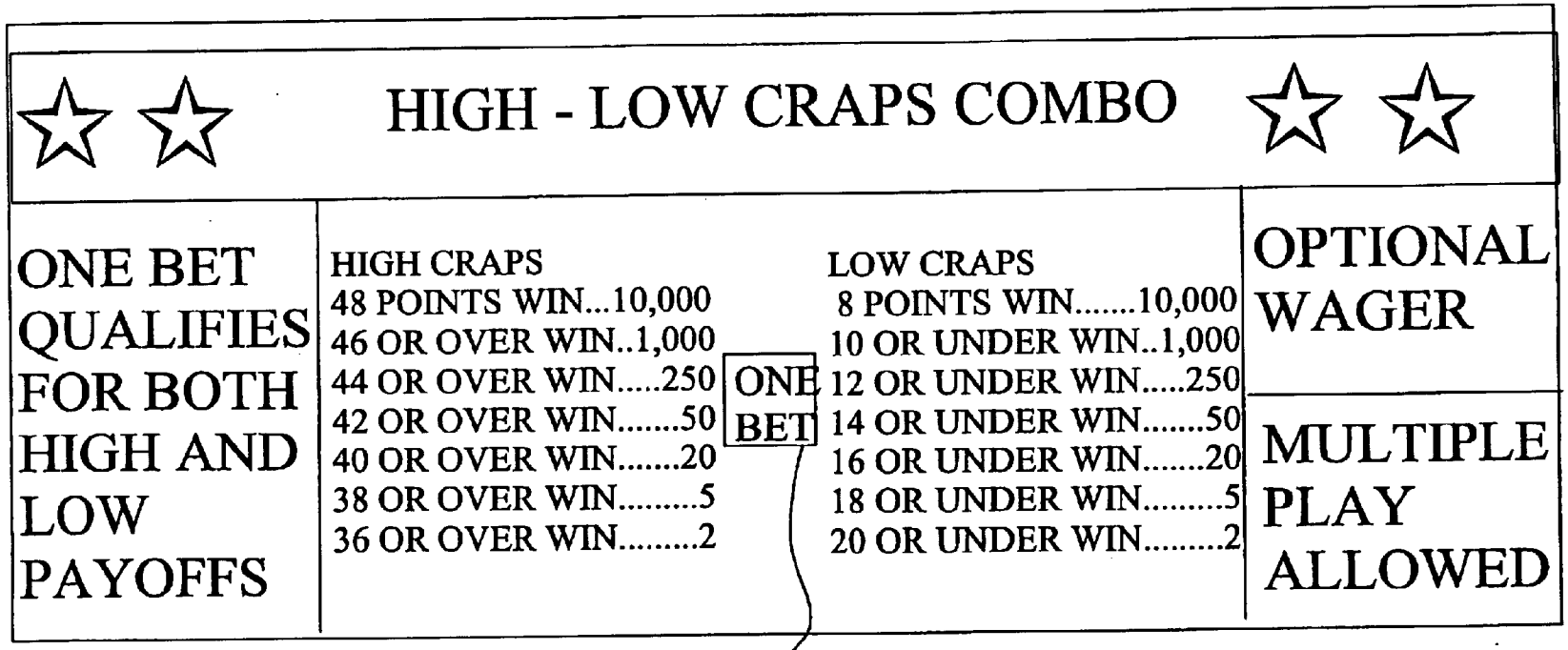

This game is preferably played with two six-sided dice. A video version of this game is shown in FIG. 5. The only difference between the video version and the table top version would be a wager location for the different wagers shown for each separate player. There are no naturals, no craps, nor is the repeat of numbers involved in determining a decision. The entire thrust of this game is based solely on adding the actual numbers rolled in a predetermined number of rolls.

There are 36 different combinations that can be rolled with two six-sided dice. The average number of points that appear in each roll is seven. This is determined by dividing the 252 total points that appear by the 36 different combinations.

In order for any gaming device to be deemed practical, a house advantage is required. It is built into this game by stipulating if the total number of points rolled in a predetermined number of rolls, add up to a preselected number, all wagers lose. As seven is the average number of points that appear in each roll, it is multiplied by the number of rolls required in determining a decision to arrive at that preselected number.

Before the first of the required number of rolls is made that determines a decision, participants have the option of wagering on either high or low craps. The following is based on a decision rendered each four rolls of the dice. When multiplying the seven points per roll average by the four rolls that determine a decision, 28 becomes the number used to divide high from low craps.

High Craps

A wager may be made at the high craps location 62. To win this wager the total number of points appearing with four rolls of the dice must exceed 28 points.

Low Craps

A wager may be made at the low craps location 63. To win this wager the total number of points appearing with four rolls of the dice cannot exceed 28 points.

House Advantage

Occurs when the total number of points appearing with four rolls of the dice total exactly 28 points.

High-Low Craps Combo

This feature offers a payoff on two opposite functions, rolling all high numbers or rolling all low numbers. This feature requires only one bet to qualify a bettor for both the high and the low scheduled payoffs. This wager is made at the combo location 64.

Wagering on this feature is designed to maintain participants' interest and create excitement with every roll of the dice required in reaching a decision. Its structure will accomplish this goal by allowing a bettor to participate with both the high and the low craps payoff with only one bet.

Monitor and Display

A portable electronic brass urn may be attached to each table for monitoring and displaying purposes. Its function is two-fold: display the last number rolled while adding the number of points that appear with each roll. This display would merely take the numbers shown on the video version shown in FIG. 3 and place those numbers as they are generated in the table top version. Similarly, the electronic displays on the other tables disclosed herein could be consolidated at a single location.

High-Low Craps Combo

Figures 8, 8A:
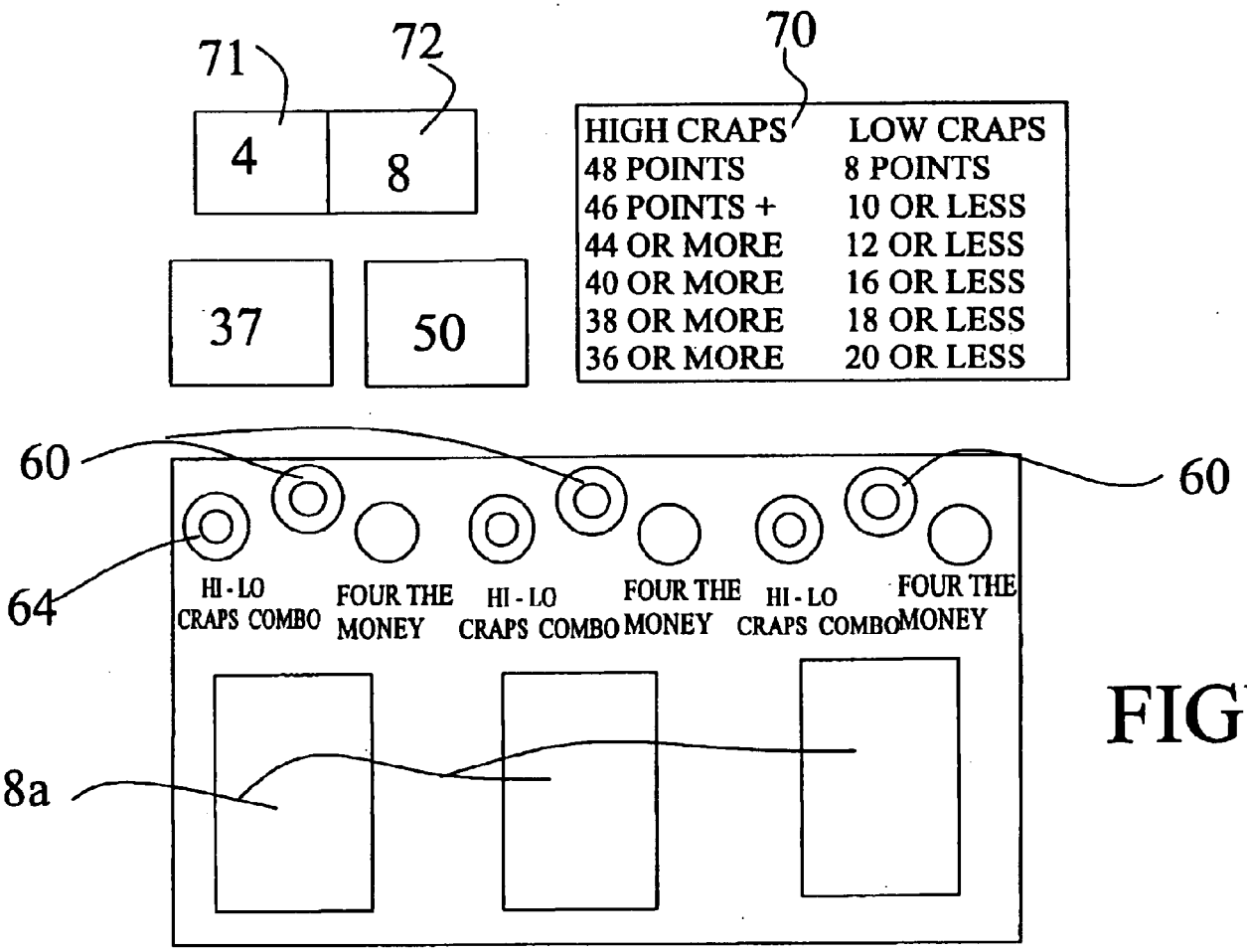
FIG. 8 is an alternate embodiment of the game of FIG. 3 in a table top version.
FIG. 8*a* is a detail view of item "FIG. 8*a*" shown in FIG. 8.

Referring to FIG. 8, the odds wagers may be shown on a wager display 70. A Four The Money decision display 71 shows the number of rolls (1–4). A total rolls display 72 shows a roller's entire roll. A tally decision display 73 shows the total of the four rolls (here 37). A tally total display 74 shows a tally of all the rolls. This type of layout provides for a table top game or a video game having multiple users.

A location for a combo wager 64 is provided providing enhanced odds and giving a player who fails to make a high or low craps win a second opportunity to win. The odds are shown in the chart 70.

| High Craps | Low Craps |
|---|---|
| 48 points win 10,000 | 8 points win 10,000 |
| 46 or over win 1,000 | 10 or under win 1,000 |
| 44 or over win 250 | 12 or under win 250 |
| 42 or over win 50 | 14 or under win 50 |
| 40 or over win 20 | 16 or under win 20 |
| 38 or over win 5 | 18 or under win 5 |
| 36 or over win 2 | 20 or under win 2 |

This wager 64 is based on total points accumulated each four rolls. 1) The high craps wager pays when the actual value of the dice rolls over a series of four dice rolls averages nine or more per roll for a total of thirty-six or more. 2) The low craps wager pays when the actual value of the dice rolls over a series of four dice rolls averages five or less per roll or less for a total of twenty or less.

This feature requires an additional wager be made at the combination location 64. The only function of this feature is to offer a multiple type payoff that ranges from a small to an extremely large payoff. This feature is designed to blend with both a high or low craps wager as each four rolls of the dice constitute a decision on this feature also.

Accumulated Points

Accumulated points are shown at the accumulated display 65. This feature is designed to add the numbers rolled on both dice for each of the four rolls required to constitute a decision. After each four roll decision is totaled the function of this feature is terminated.

Consecutive Accumulated Points

This feature is designed to track the points accumulated with every consecutive win of a high or low craps wager. Consecutive location 66 displays this amount. Once a participant does lose their high or low craps wager it terminates the count. To win this feature a participant must acquire a pre-determined number of points. These points are accumulated with consecutive wins of a high or low craps wager. This feature will zero out the count with a loss of a high or low craps wager.

There are two termination events. The first is a set termination event which terminates each play by a single roller and is based a specific (four) number of dice rolls. The second is an accumulated termination event which terminates a players series of rolls which occurs when the player has bet that the total value of the dice rolls is within a first range and the value then falls within a second, different range. Examples of these ranges are, odd numbers, even numbers, above 28, below 28 or equal to 28. The preferred embodiment of this game, set forth above uses above 28 and below 28 as termination events.

To qualify as a shooter, a participant must place a wager on high or low craps. The winning or losing of this preferred embodiment is determined by totaling the number of points that appear in a predetermined number of rolls. The minimum number of points required to win a high or low craps wager is determined by multiplying the seven average number of points that appear with each roll by the predetermined number of rolls.

To win a high craps wager, a shooter must exceed this average whereas to win a low craps wager, the total number of points accumulated must be less than that average number. A house advantage is built in this preferred embodiment by declaring both high and low craps wagers lose if the total points accumulated add up to the exact mathematical average.

An example of this, is requiring four rolls of the dice to determine a decision. When multiplying the seven average number of points that appear with each roll by the required four rolls, 28 points is the average number of points that appear with four rolls. A house advantage is built in by declaring both high and low craps wagers lose if the total number of points that appear with four rolls of the dice total exactly 28 points. Winning wagers on this preferred embodiment pay even money and determine if a participant continues on as the shooter. Wagers on this preferred embodiment are also the criteria that qualifies a bettor to wager on either the odd or even embodiment prior to any roll of the dice.

The random number generator in the above example is a set of dice. This game in an alternate embodiment uses cards to generate numbers, even though two cards need not be added to get the second number. In cards, a set of at least three cards (e.g. 2, 3, 2) could be added to get the result (here 7) to give a jackpot. In this example three aces could be the lowest three card hand and three tens might be the highest hand.

Odd or Even

With conventional craps, the multiple of odds allowed are based on a pass or don't pass wager. With this invention, the wagering on odd, at the odd location 67, or even, at the even location 68, prior to any desired roll serves as a replacement. The multiples allowed each time are determined by the casino host and may vary from casino to casino. Because there is no house advantage with this embodiment, the criteria for allowing bets on this feature is based on a high or low craps wager. Since an odd or even decision is determined every roll of the dice, the number of different times a participant can bet on this feature is based on the number of rolls required to win a high or low craps wager.

High-Low Craps Combo

Winning or losing of this optional feature is determined by the final number of points rolled in a predetermined number of rolls. Whereas the winning or losing of a high or low craps wager has a single target number with an even money payoff. This feature offers a multiple type payoff based on a shooter's ability to roll the high maximum or low minimum number of points that can be rolled in a predetermined number of rolls. The closer to the maximum or the minimum number of points possible, the higher the payoff.

The maximum number of points that can be rolled with four rolls of the dice is 48, while the minimum number is 8. The payoff structure for this feature is based on the mathematical odds of how close a shooter comes to the ultimate high or minimum low number of points that reward a payoff. Based on four rolls of the dice, a high craps payoff could range from 36 to 48 points While the low craps payoff could range from 8 to 20 points.

Because one bet on this feature does qualify a participant for both the high and the low craps payoff, this composite feature maintains interest of all participants throughout the predetermined number of rolls required in determining a decision.

Video Slot Functions

1) Screen displays four rolls 101–104 of the dice, one at a time.
2) Decision display 65 capable of adding the number of points that appear with each of the allotted four rolls.
3) Total accumulated point display 66 to show the total number of points that appear prior to the termination event.

Once a participant loses their High or Low Craps wager, the total accumulated display 66 goes to zero (0). The total accumulated display 66 is for the purpose of offering a jackpot payoff. Single player version can offer a jackpot payoff when a predetermined number of points are accumulated with consecutive high or low craps win. Each multiple player game can offer a progressive jackpot based on its percentage of play. Participants must choose either high or low craps, they cannot play both. Both single and multiple player jackpots are free as all four features of game have built in vigorish, or house advantage. An example of a single player jackpot pay off would be when the player accumulated 300 points for a pre-determined payoff. An example of a multiple player progressive jackpot would be when the player accumulated 500 points and would then win that table's progressive jackpot. A base jackpot payoff on 28 being the average number of points that appear with four rolls of the dice. Another option would allow a tie to cancel out the accumulated points on the jackpot feature, another option would not.

High Roller of the Month

How to Play

This feature is designed to offer two different payoffs with only one function. Reward all bettors with a large immediate payoff while qualifying the shooter as a high roller of the month jackpot winner. All qualifying shooters will share in this monthly progressive jackpot.

Each monthly contest begins on the first minute of the first day of each day of each month and ends on the last minute of the last day of each month. The winning or losing of this feature is based solely on adding the actual numbers rolled during each participating shooter's turn. Both the immediate and jackpot payoff are determined by adding the actual numbers that appear on two six-sided dice prior to seven out.

To win, a shooter must accumulate 300 points or more. When a shooter does seven out, those seven points are not added to the total. The shooter does not have to bet this feature in order to qualify.

To qualify a shooter as a High Roller of the Month winner, a total of $5.00 or more must be bet on this feature. It makes no difference if the shooter bets it or not, as long as the total bets equal or exceed the $5.00 required to qualify. Additional money is added to the jackpot with each participating shooter.

Jackpot Payoff

1st place receives 20%
2nd place receives 15%
3rd place receives 10%
4th place receives 5%

The remaining 50% will be divided equally between all qualifiers, including 1st, 2nd, 3rd, and 4th place winners.

The jackpot payoff feature is adaptable with this invention as a table game, a video (slot) game, or can be an added feature with the rules of play of conventional craps. To win, a shooter must accumulate a predetermined number of points based on the rules of play of each different type of game.

This invention is designed to offer a large immediate payoff to all bettors and/or qualify the shooter as a High Roller of the Month jackpot winner. All qualifying shooters will be eligible to share in this monthly progressive jackpot.

Each monthly contest begins on the first minute of the first day of each month and ends on the last minute of the last day of each month. The winning or losing of this feature is based solely on adding the actual numbers rolled during each participating shooter's turn. Both the immediate and High Roller of the Month payoffs are determined by adding the actual numbers that appear on two six-sided dice bearing numbers 1 through 6. The requirements may vary with different versions of this invention and will be determined by each version's rules of play.

Video (Slot) Game

A video (slot) version of this invention is envisioned displaying four different rolls of two six-sided dice bearing numbers 1 through 6. Those four rolls will constitute a decision on a high or low craps wager, which are the preferred embodiments of this invention. The number of points rolled with each four different rolls will be electronically totaled and determine the winning or losing of a high or low craps wager.

A jackpot based on a predetermined number of points being accumulated will be established with a target number that can be reached with consecutive high or low craps wins. A special screen will add and display the number of consecutive accumulated points.

Display and Monitoring

During the play of a manually controlled dice game, tracing the number of points necessary to win can best be done by the use of electronic methods. The device used must have the ability to add the accumulated points as well as display the total count of each participating shooter. To register the number of points accumulated with each roll, there are 11 buttons bearing the numbers 2 through 12. The appropriate button punched by the casino host will monitor and display the count of accumulated points.

This device will also have the ability to add additional money to a progressive type jackpot that is based on a predetermined time period. When this jackpot feature is made a part of a conventional played dice game and a seven out is rolled, those seven points will not be added to the total count.

Method of Generating Random Pay Outs

Figure 3:
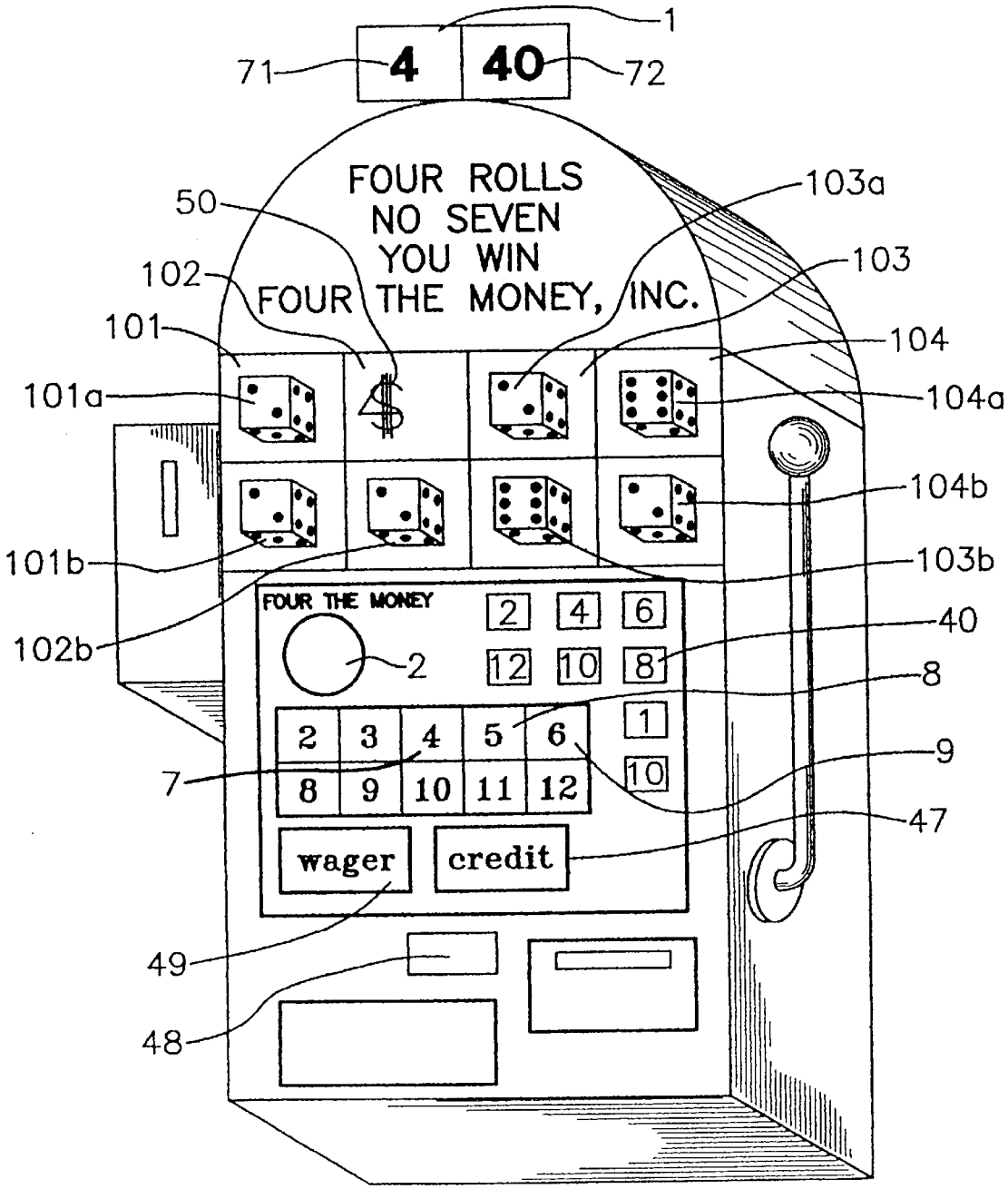
FIG. 3 is a video layout for practice of the same.

A randomizing method for Casino Video and Slot Games is taught or shown in FIGS. 3 and 5.

The first randomizing method is broad and involves the use of at least one, but usually two sets of dice means (random number generators) in a game with rules to generate a random payout for a video game. The display may include three (3) rolls of two (2) dice of these double displays as shown in FIGS. 3, 5, 6 and 7. This specific game while similar to the table top version has important differences.

The technology may be shown by exemplary disclosure set forth below.

A display for this method of playing a betting game using multiple random number generation having a set event which terminates the multiple number generation comprises the steps of:

a) providing at least three columns for viewing b) displaying at least two random numbers, being a first and second random number, generated in each of the at least three columns;

c) providing a payout based on the combination of the total of the two random numbers displayed in each of the three columns;

d) providing a payout based on the comparison of each of the columns to the adjoining column;

e) providing a payout based on the comparison of each of the first random numbers to the corresponding first random numbers generated in the adjoining column;

f) providing a payout based on the comparison of each of the second random numbers to the corresponding second random numbers generated in the adjoining column.

In addition to these specific functional formats, a method of generating a randomized result in a video or slot machine type game is disclosed. First, a game with rules must be devised which has a set termination event. The best examples are a set number of rolls (4 in the high low craps embodiment set forth above) or upon reaching at least one target number (such as the generation of a seven in the example for four the money) which presets the maximum number of runs with a payout possible on at least one of the multiple number of runs. The game may have a specific number of runs, with a payout possible for each roll (such as 40 rolls in the four the money preferred embodiment) or may have the number of runs limited only by statistics.

In one embodiment, this result generated would be defined by the following steps:

a) choosing a minimum number;

b) choosing a maximum number;

c) choosing at least one termination event in the preferred embodiment generating at least one target number between the predetermined minimum and the predetermined maximum;

d) choosing at least one consecutive number;

e) generating at least one random number in response to the application of credit to the game between the predetermined minimum and the predetermined maximum;

f) repeating step (e) and maintaining a count on the number of repetitions of the recurrence of at least one count number, other than the target number, between the predetermined minimum and predetermined maximum until the at least one consecutive number comprising a predetermined number of consecutive recurrence of at least one count number between the predetermined minimum and predetermined maximum other than the target number is reached or the at least one target number is generated.

In this way, a payout may be established when the number of repetitions reaches a first preset maximum number. Similarly, the number of repetitions may automatically terminate when the first preset maximum number is reached or when a second preset number is reached.

In the preferred embodiment, individual wagers are possible. These may be automated in response to a token or credit being deposited or may be through the selection (as by touching a touch screen position, moving a mouse or other pointer to a specific location and selecting the location, keyboard input, etc) of a specific wager. This step may be described as:

(g) placing an odds wager on an odds bet number between the minimum number and the maximum number on the probability that the odds bet number will be generated prior to the at least one target number being generated.

Utilizing this method of wagering in the foreground or the background a video game or payout on a slot machine may be calculated.

To perform this calculation of a payout, the following steps would need to be added:

(h) Calculating the payout on the odds wagers with or without an additional payout on the probability of a consecutive series of rolls being made prior to the target number being generated;

(I) Giving a credit equal to the payout calculated in step (g);

(j) repeating the steps a–I until the preset maximum is reached for terminating the game or until the target number is reached.

The technology submitted may be run in the foreground as a screen game or in the background as a means of generating a randomized result and randomized payout. If run in the foreground, a single roll or all of the rolls may be displayed with or without the payout associated with each roll and information on how that payout was generated.

This means that the game may use a single coin to generate a result or may be used to have individualized wagers made on the table.

To further explain, the following examples are illustrative.

The player plays one or more credits. Credits may be in the form of tokens or coins applied or electronically maintained numeric credits.

For each credit (or set of credits) an entire game is run in the background until either of two results occurs:

(1) the target number is reached or (2) a predetermined number of consecutive recurrence of at least one count number between the predetermined minimum and predetermined maximum other than the target number is generated.

At this time, a payout is made to the player. For example, using a randomizer to generate results for two six sided dice, numbered 1–6 sequentially, and a target number of 7, a payout of one credit could be made if 4 consecutive numbers were generated prior to the generation of a 7. This amount would be doubled if two sets of 4 consecutive numbers were generated prior to the generation of a seven, tripled for 3 consecutive sets of 4 numbers, etc, up to a predetermined maximum.

If the technology set forth in step g of claim 3 above were utilized, then the credits applied to the game could be split (1) automatically or (2) by election of the player of the game to place certain wagers on 'odds' bets. Preferably, the payout on these wagers would be 'true odds'.

Examples of this automated technology using the dice example set forth above would be:

1) the credit could be divided between odds wagers.

Examples:

(a) one credit could be played (b) the game would internally divide the credit played between the odds bets (c) (I) with or (ii) without a portion of the credit being applied to the odds of a consecutive number of counts being generated before the target number is generated.

(d) the split between odds could be split equally or unequally between selected odds bets [e.g. ⅕ credit on the consecutive count bet set forth in (C), and 2 times on 6 & 2 times on 8-equal to double odds) or could be equally or unequally split between all of the odds (e.g. no credit on the consecutive count wager and 1/10th on the 6& ⅕th on the 8, 2 times on the 4, 1/10th on the 10 and ⅓th on the 9.]

(e) Similarly, this split between odds could be randomized so that a percentage of the credit was randomly assigned between the different odds wagers.

2) the number of odds wagers could increase with the number of credits played.

For example, the first credit could go to the wager that a predetermined number of consecutive recurrence of at least one count number between the predetermined minimum and predetermined maximum other than the target number is reached (four using the two six sided dice); the next credit might put an odds wager on the six, the next a second odds wager on the six or a separate wager on the 8, etc.) This division could be (1) randomly assigned or (2) be assigned by direction of the player or (3) could be assigned by pre-programmed directions.

3) the numbers of sides of dice used could be increased or decreased depending on the number of credits played;

This very complex arrangement would vary the odds and payout by changing the numbers of sides of the dice used depending on the amount of credit paid.

Figures 6A, 6B:
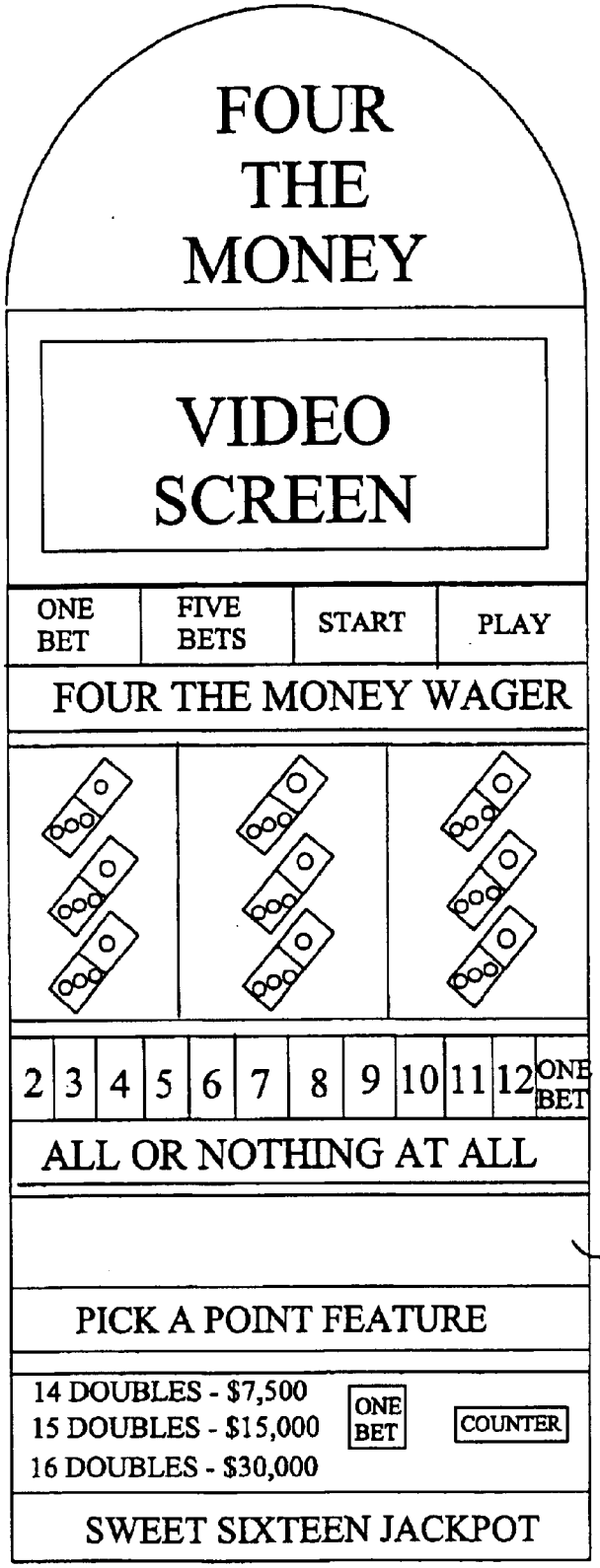
FIG. 6*b* is a detail view of item "FIG. 6*b*" shown in FIG. 6*a*.
Figure 6B:
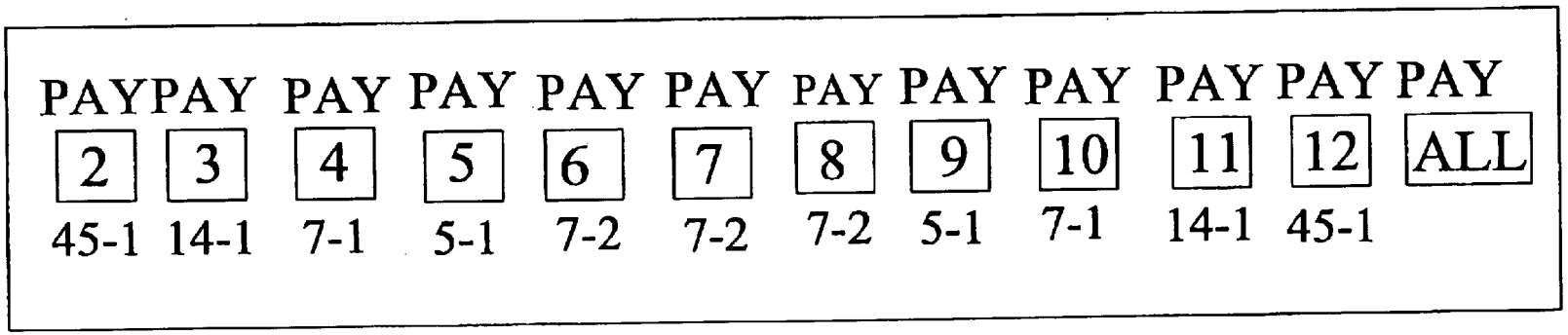

As can be seen by reference to FIG. 6, as many 9 rolls can be displayed to achieve a result in machines tied together for a common jackpot.

The number of consecutive rolls could be increased or decreased depending on the number of credits played.

For example, the first credit could give up to 10 rolls, the second credit up to 20 rolls, etc.

Obviously, any combination of the variations set forth above in items 1–5 and their subparts could be used.

In this way, roller's entire roll run (a number of consecutive rolls before rolling a target number, such as a '7') in the background with odds placed on all or some of the numbers would generate a highly randomized payout. The dice may be from 1 to an infinite number and the number of sides of each dice may be likewise changed.

It should be noted that all number generation in a video format would take place on a computer platform. Only the payout need be shown, although each consecutive roll, odds played, payout on each roll, etc. could also be shown to enhance player participation.

In another embodiment, the player would place each bet individually. Since this requires a template for the player to make the wagers, FIG. 3 is provided to show an example of the template which could be used.

In this embodiment, the player would put money into a slot 46 provided in a slot machine and generated credits would appear in the credit location 47. The player could have these credits returned to the player by hitting player payout location 48. This would allow the player to 'cash out'. To make a wager the player would touch the wager amount location 49. In this location 49 a number would appear from 1 to a predetermined maximum. Each time the player touched this location 49 the number appearing would increase. By touching the credit location 47 the number in the wager location 49 would return to zero. When the number in the wager location 49 satisfied the player, the player would touch the "FOUR THE MONEY WAGER" location 2 or the odds wager locations 13–14 to place a wager in the preset amount on the wager location 49 on that location. The wager location 49 would then return to zero, the credit location 47 number would be reduced by the amount of the wager and the wager number would appear on the location where the wager appeared. By selecting this wager again and touching the credit location 47, the wager would be removed and added back to the credit location. This allows the player to vary his play greatly during the game.

When the player had placed all wagers desired, the roll could be selected to generate a number on each set of the dice 101–104 and a payout or forfeiture of wagers would occur depending on the results. In one embodiment, a wager would automatically be made or required to be made on the "FOUR THE MONEY WAGER" location 2 before play on any odds wager location 3–14.

Examples of the games possible are shown in the following examples. These could be used if the game was played by the player as shown in FIGS. 3 and 5 or was run in the background with automated wagering with wagers of present or randomly selected amounts.

Although this shows 4 rolls, a counter could show three (3) rolls or as many rolls as desired (in the preferred embodiment up to 40 rolls).

Figure 4C:
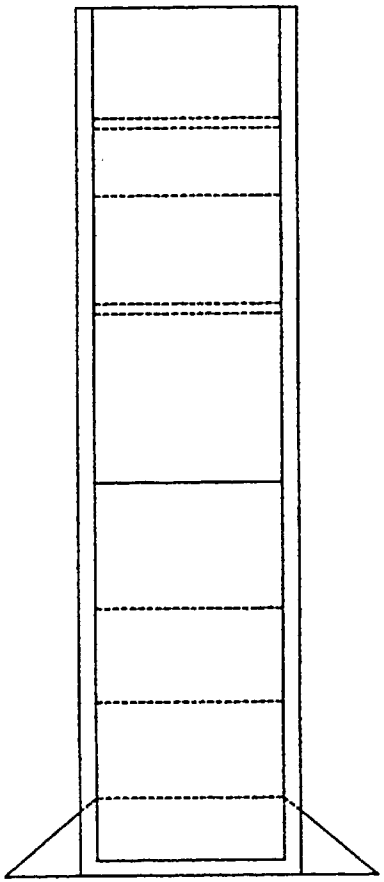
FIGS. 4*a*–4*c* are cross sectional views of the chute described herein.
Figure 4B:
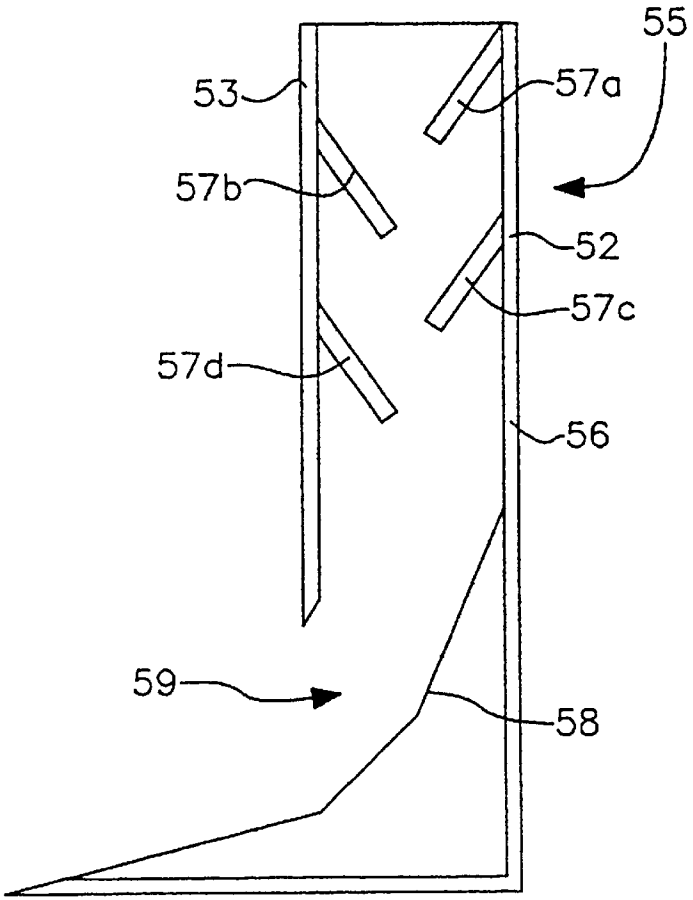
Figure 4A:
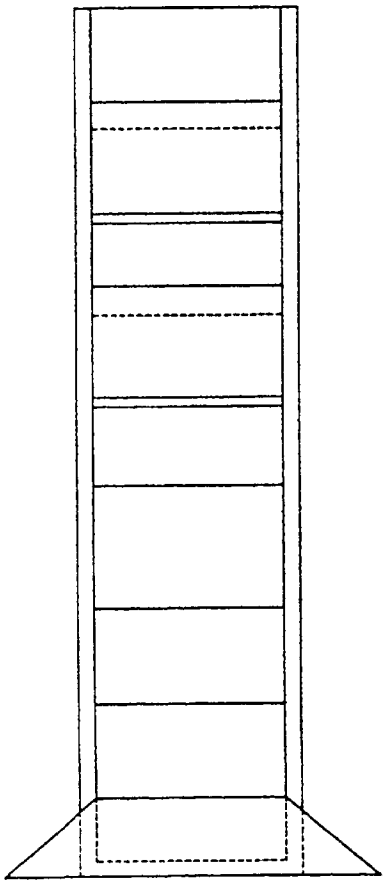
Figure 7:
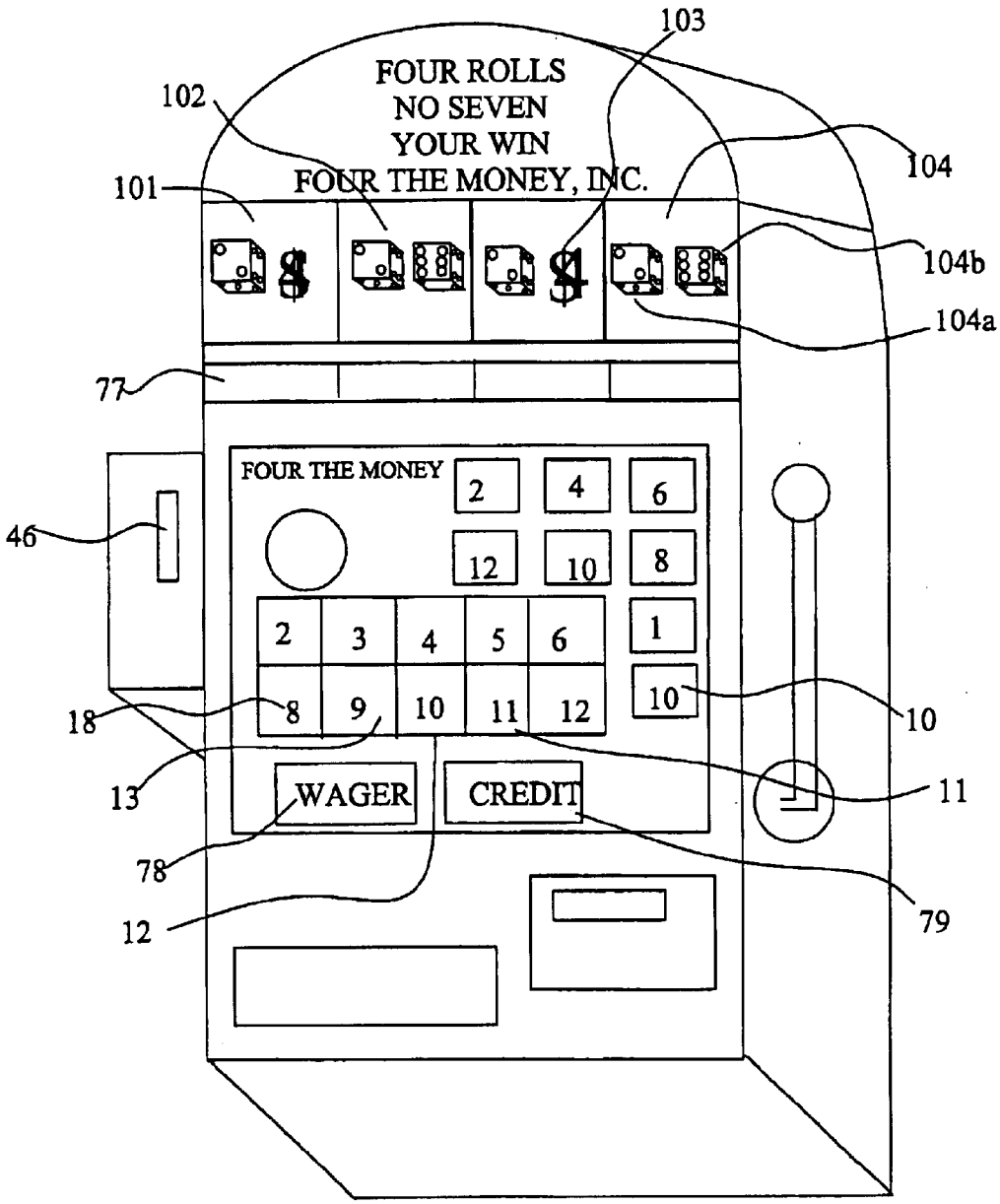
FIG. 7 is an alternate embodiment of the video layout of FIG. 3.

One concept embodied here in is the display with a multiple but preferably four randomly generated dice rolls in a row. In the preferred embodiment these rolls appear along a top row 101*a*, 102*a*, 103*a* and 104*a* and 101*b*, 102*b*, 103*b* and 104*b* a bottom row as shown in FIGS. 3 and 4. The top and bottom row together equal a single roll. Likewise, the total may be displayed with the total of both dice in a single row as shown in FIG. 7 or replacing the dice with the numeric result of their additions.

Video play is initiated with the deposit of money followed by the actuation of the random number generator. All of the results would be altered in favor of the player (except the true odds and "FOUR THE MONEY" wager) in the event that multiple coins were used consistent with current technology.

In one embodiment, there are 8 random results generated, 4 net results are reached by adding these random results. Each of these generate (1) a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results may be accompanied by a symbol.

1. The numeric result is generated by adding a pair, the top dice roll to the bottom dice roll, for each of four columns. Top and bottom may be replaced with side by side displays without departing from the embodiment set forth herein.

In this embodiment, the symbol may be associated with a number (e.g. 1 and the symbol appearing together) in order to obtain a numeric result greater than one where a symbol is used.

2. If the four generated pairs are generated without a pair total of seven (or other target), a first payout occurs. Without any further action of the player, the game continues in the fashion until a seven is encountered.

In the first embodiment (a), the symbol acts as a free pass since two dice are necessary to generate a seven.

3. The game may also track the number of hard ways.

If a predetermined numbered hard ways are generated before a seven is generated a payout may occur.

For each additional hard way generated before a seven, this total maybe increased.

4. The game may also track the top and bottom row of numbers.

If the same number appears three times across the top, a payout maybe made.

E.G.: three threes in a row across the top could pay 10.00

If the same number appears four times across the top, a heightened payout maybe made.

E.G.: if four tens in a row across the top would pay 100.00.

A symbol 50 could be a wild card. Hence, if two threes and a symbol 50 appeared, the game could pay 10.00 for this combination.

If all the symbols 50 appeared across the top, a higher payout could be made. If all of the symbols appeared across the top and bottom (8 symbols 50 displayed) a jackpot payout could be made. The symbol shown herein is the trademark for the primary wager based on four rolls without a seven (7).

The jackpot could start out at one amount and would increase in increments utilizing a percentage of each wager made.

In addition, the game could allow the player to wager on true odds that a number would appear before a seven in the second embodiment (b). By pushing a button or a touch screen location provided with the number to be selected, the player could chose which numbers to place these odds bets. A wager on the "FOUR THE MONEY" location (four rolls without a seven) would be required to place these wagers.

If the game went through a larger number, here forty rolls, or forty (40) cycles, without a seven appearing, a higher payout could be made and the game would start again.

Video play is initiated with the deposit of money followed by the actuation of the random number generator.

In the preferred embodiment, there are 8 random results generated. These are shown on the screen. Each of these generate (1) a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results is accompanied by a symbol.

Since the odds in the house favor may not allow for sufficient payout of the bets other than the "FOUR THE MONEY" bet set forth below under the second embodiment (b), in the first embodiment (a) at least one additional symbol result is provided to allow for a payout to the other odds set forth below.

The game may be described as:

a) selecting a target;

b) generating at least two random numbers in response to the application of a credit to the game;

c) Displaying each of the at least two random numbers;

d) providing a credit if the two random numbers occur prior to the target occurring; or d) providing a credit if the target occurs during the display of the at least two random numbers.

This game could be continuously repeated in exchange for a single coin until a next step, the occurrence of the target number or in traditional craps the craping out of a player.

A dice type game generated by action of a microprocessor according to a set of rules which provides for termination (such as the rules for craps or "FOUR THE MONEY") would be played out for at least one roller's entire turn and the payout made to the player based on the results of that player's roll where the roll is defined by several different throws of the dice. For example, a craps format roll would be to make a payout until the player made a point and then rolled a seven before making that point. In a "FOUR THE MONEY" format, the roll would be defined in terms of all rolls of the dice prior to the occurrence of a seven.

The game so defined might be further refined by providing that additional bets be made automatically as the game is played. For example, a dollar bet might only make a come out bet plus odds, but as additional wagers were won, additional bets might automatically be placed.

The displays possible include: 1) a single display of a single roll of the dice; 2) a list of multiple rolls scrolled down the screen; 3) a changing payout based on rolls shown in groups or individually on the screen as each group is made.

FIG. 3, which shows a "FOUR THE MONEY" slot machine. Multiple machines may be tied into one High Roller of the Month Jackpot. This is to be distinguished from a multi user game where many players wager on a single player's roll. This machine shows three or four columns 101–104. Each column shows two dice 101*a*, 101*b*, etc. type numeric rolls. Whenever one of the three or four columns adds up to seven (or other target number) the game ends. Until then, numbers may be generated with pay outs. This compares to a typical game on a slot machine where whenever a set is displayed there is a payout. This compares to a typical game on a slot machine where whenever a set is displayed there is a payout. The absence of a set (a seven or other target) generates a payout in this game.

Video play is initiated with the deposit of money followed by the actuation of the random number generator. All of the results would be altered in favor of the player (except the true odds and "FOUR THE MONEY" wager) in the event that multiple coins were used consistent with current technology.

In the preferred embodiment, there are 8 random results displayed as 101*a*, 101*b*, 102*a*, 102*b*, 103*a*, 103*b*, 104*a*, 104*b* generated. Each of these generate (10 a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results is accompanied by a symbol.

In addition, the game could allow the player to wager on true odds that a number would appear before a seven in the second embodiment (b). By pushing a button or a touch screen location provided with the number to be selected, the player could chose which numbers to place these odds bets. A wager on the "FOUR THE MONEY" location (four rolls without a seven) would be required to place these wagers.

If the game went through a larger number of cycles or rolls, e.g. 40 cycles, without a seven appearing, a higher payout of 1200 could be made and the game would start again consistent with one version of the table top game.

As can be seen, the major concept lies in having dice rolls generated and having a certain target stop the game.

The technology submitted may be run in the foreground as a screen game or in the background as a means of generating a randomized result and randomized payout. If run in the foreground, a single roll or all of the rolls may be displayed with or without the payout associated with each roll and information on how that payout was generated.

This means that the game may use a single coin to generate a result or may be used to have individualized wagers in the same way wagers are made on the Four the Money table.

The player plays one or more credits. Credits may be in the form of tokens or coins applied or electronically maintained numeric credits. For each credit (or set of credits) an entire game is run in the background until either of two results occurs:

(1) the target number is reached or (2) a predetermined number repetitions occurs or (3) another termination event occurs.

At this time, a payout is made to the player. For example, using a randomizer to generate results for two six sided dice, numbered 1–6 sequentially, and a target number of 7, a payout of one credit could be made if 4 consecutive numbers were generated prior to the generation of a 7. This amount would be doubled if two sets of 4 consecutive numbers were generated prior to the generation of a seven, tripled for 3 consecutive sets of 4 numbers, etc, up to a predetermined maximum.

If the technology set forth in step g of claim 3 above were utilized, then the credits applied to the game could be split (1) automatically or (2) by election of the player of the game to place certain wagers on 'odds' bets. Preferably, the payout on these wagers would be 'true odds'.

Examples of this automated technology using the dice example set forth above would be:

1) the credit could be divided between odds wagers.

Examples:

(A) one credit could be played (B) the game would internally divide the credit played between the odds bets (C) (I) with or (ii) without a portion of the credit being applied to the odds of a consecutive number of counts being generated before the target number is generated.

(D) the split between odds could be split equally or unequally between selected odds bets (e.g. ⅕ credit on the consecutive count bet set forth in (C), and 2 Thais on 6 & 2 Thais on 8-equal double odds) or could be equally or unequally split between all of the odds (e.g. no credit on the consecutive count wager and ⅒th on the 6& ⅕th on the 8, 2 Thais on the 4, ⅒th on the 10 and ⅕th on the 9).

(F) Similarly, this split between odds could be randomized so that a percentage of the credit was randomly assigned between the different odds wagers.

The number of odds wagers could increase with the number of credits played.

For example, the first credit could go to the wager that a predetermined number of consecutive recurrence of at least one count number between the predetermined minimum and predetermined maximum other than the target number is reached (four using the two six sided dice); the next credit might put an odds wager on the six, the next a second odds wager on the six or a separate wager on the 8, etc.) This division could be (1) randomly assigned or (2) be assigned by direction of the player or (3) could be assigned by pre-programmed directions.

Figure 9:
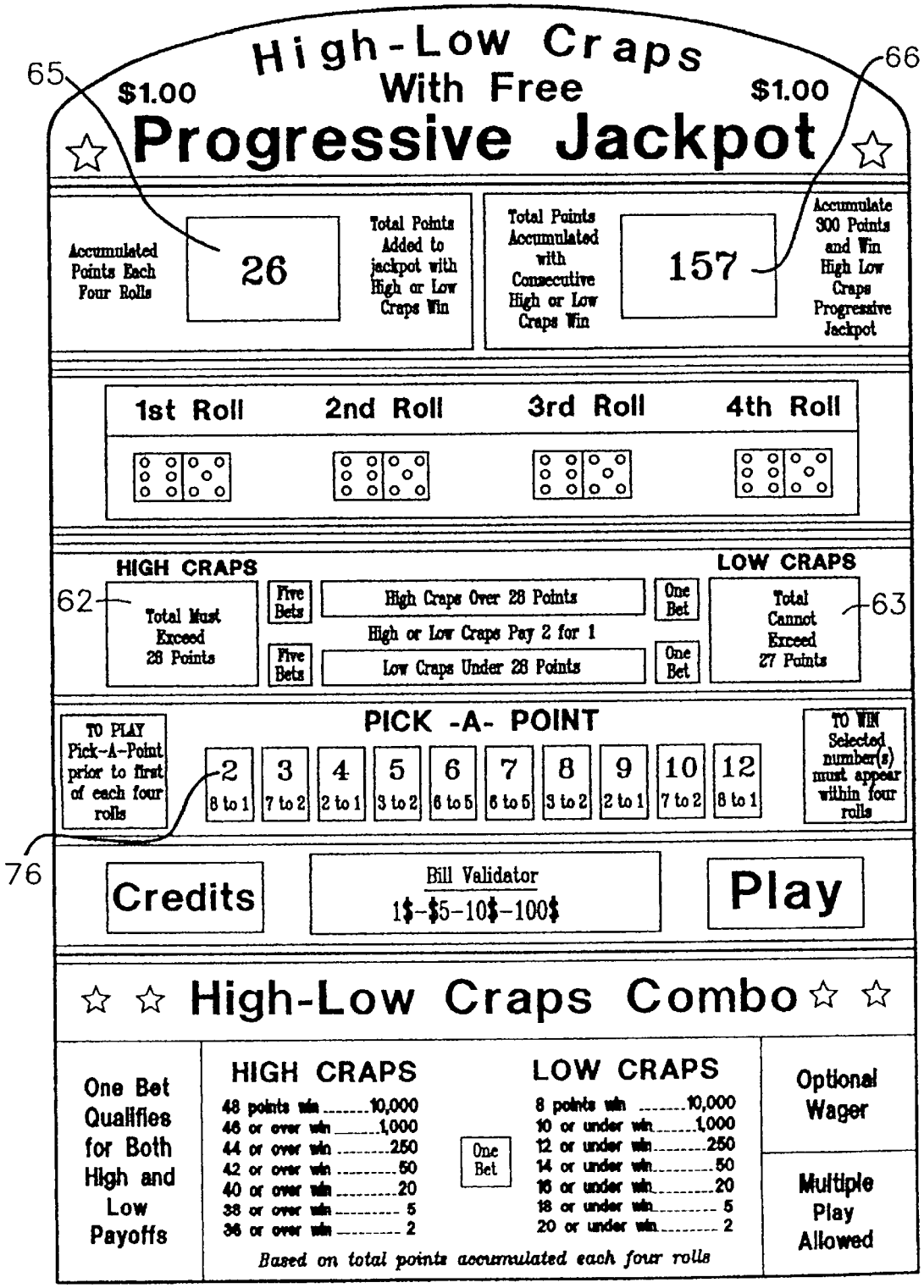
FIG. 9 is an alternate embodiment of the game shown in FIG. 5.

One final embodiment is shown in FIG. 9. The only change in this embodiment from that shown in FIG. 8 and FIG. 5 is the location of a pick a point feature providing true odds wagers 76 on the occurrence of a number before the end of four rolls. The payouts are shown on the display next to the number. For example, the odds of the 2 are 8 to 1. The payout would be 8 token to 1 tokens.

Figure 10:
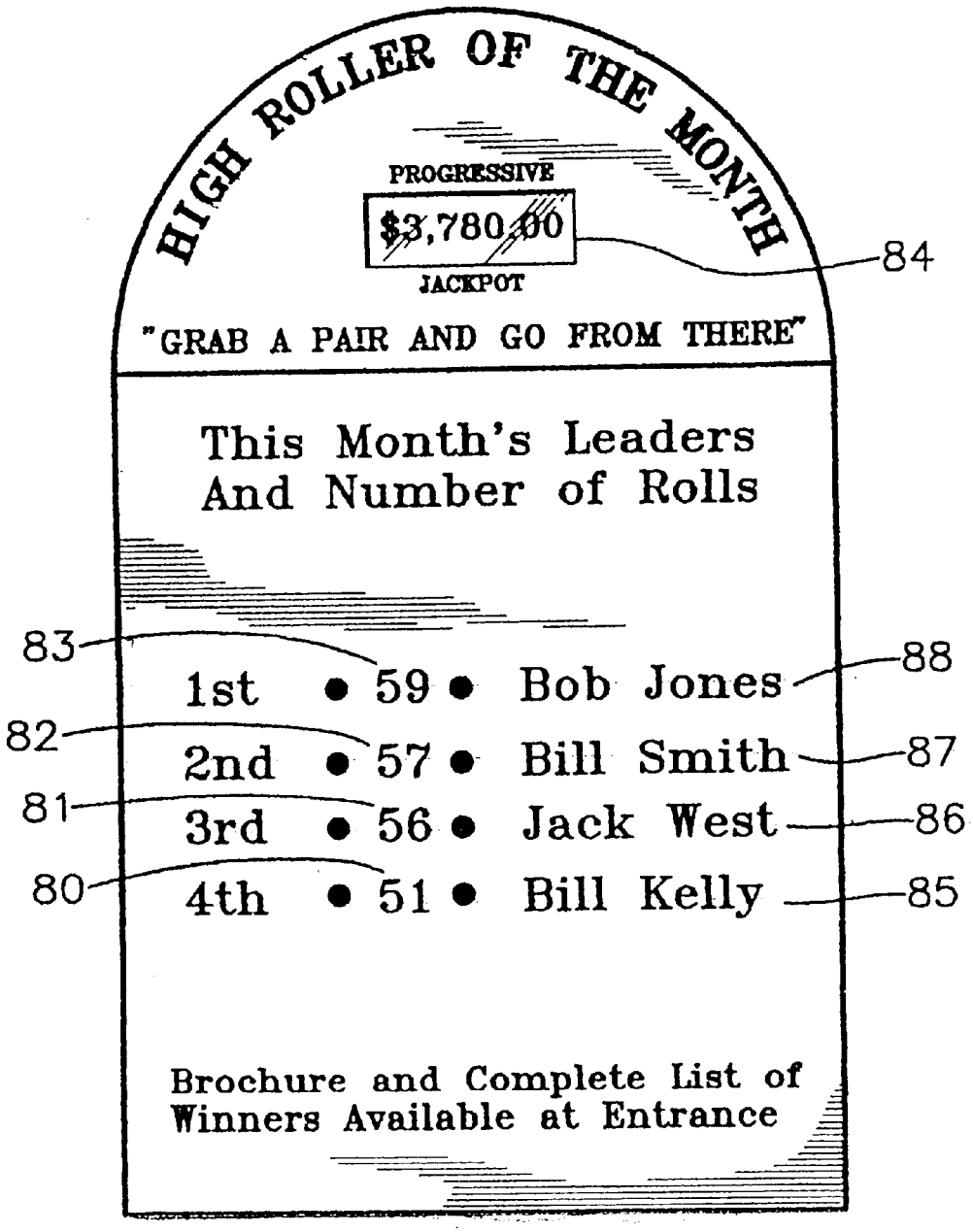
FIG. 10 is a display utilized by the game shown in FIG. 1 or 2.
Figures 11, 11A:
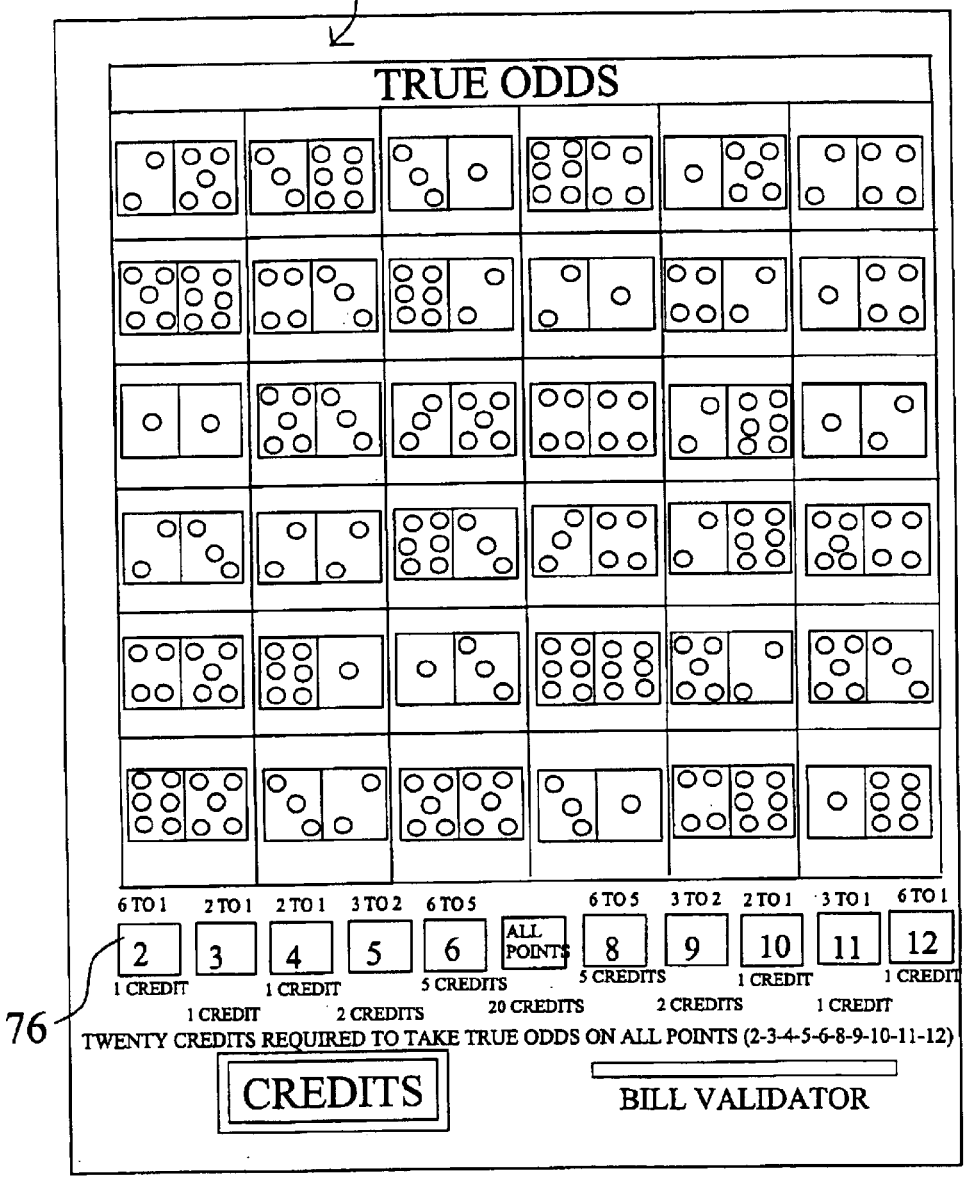
FIG. 11 shows an alternate placement of the true odds wager 76.
FIG. 11*a* is a detail view of item "FIG. 11*a*" shown in FIG. 11.
Figure 11A:
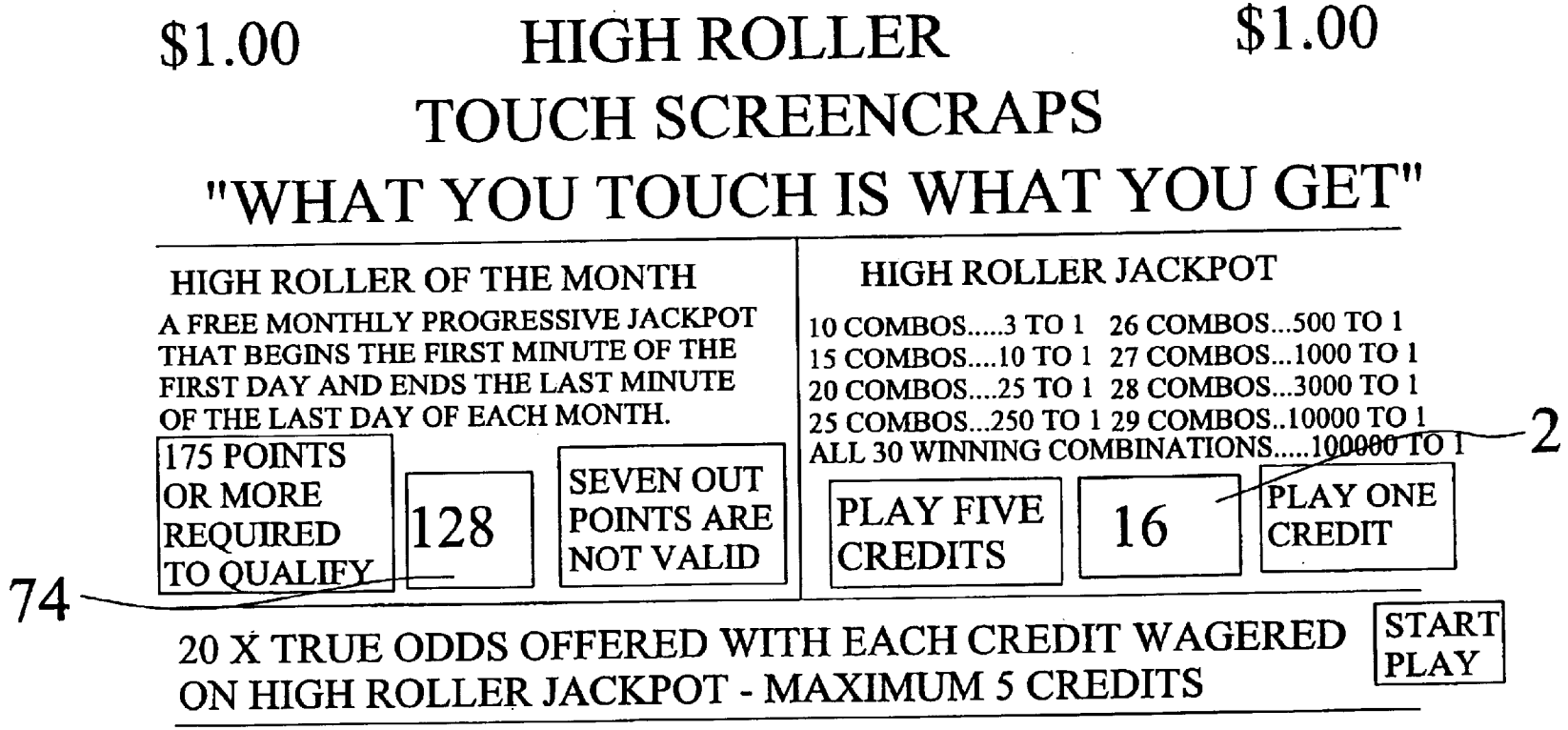

FIG. 10 shows how the high roller of the month may be displayed with the first 88, second 87 and third 86 and fourth 85 leaders or winners displayed. A portion of the wager necessary to qualify for the high roller payout (based on achieving a certain number of rolls (FIG. 1 or 2 provides this type of payout with the Forty O'Lordy wager 17 with a wager location 60 which has a high payout for rolling forty rolls without a seven) or points (this is shown in FIG. 5 where a count of points is shown at 66 and where a portion of the wager may go towards this jackpot from the other wagers made). In the preferred embodiment, the high roller wager would be $5.00 so that an adequate jackpot could be generated while providing a generous payout to those qualifying (via the high count type payout shown in FIG. 1 or 2 or the High Point payout shown in FIGS. 5, 8 and 9). While this is not specifically designated on the drawings, payouts for achieving more than 300 points in the preferred embodiment would pay between $1000 and $2000 immediately while qualifying the winner for the high roller of the month. The numbers 80–93 displayed on FIG. 10 show the count total (total number of rolls) in the first embodiment of High Roller of the month, although if not minimum number of points were necessary, these could be points. The total jackpot for a given month is shown as $3,780 84.

The Shute

A random number generator for generating numbers between a predetermined minimum and maximum using at least one dice is shown in FIG. 4. This device defines a chute 55 and is covered by the trade name "SHUTE". It preferably is defined as a tower having at least four walls, a top 50 and a bottom 51, said walls including a first opposing wall 52 facing a second opposing wall 53;

b) at least one first shelf 57*a* on said first opposing wall slanting from said first opposing wall towards the bottom having a width and a length away from said first opposing wall;

c) at least one second shelf 57*b* on said second opposing wall slanting from said second opposing wall towards the bottom having a width and a length away from said first opposing wall wherein at least a portion of said second shelf is below said at least one first shelf so that a dice falling from above the at least one first shelf may roll from said first shelf onto said at least one second shelf and from said at least one second shelf to the bottom. As shown in FIG. 4*b* there is a second first shelf 57*c* and a second shelf 57*d* to adequately randomize the dice.

The slant of the shelves may be reversed so that the dice may be randomized by reversing the direction of the shelves and turning the tower on its top.

The top is open so that the dice may be placed within the top.

The chute has an inside and an outside and the bottom 51 is further defined as having defining an opening 59 from the inside of the tower to the outside of the tower and a ramp 54 which slants from at least one wall towards the bottom and the opening so that the dice, upon landing on the ramp tend to move towards the opening and out of the internal area of the chute.

Multi Wheel Games with Spinning Wheels

Figure 14:
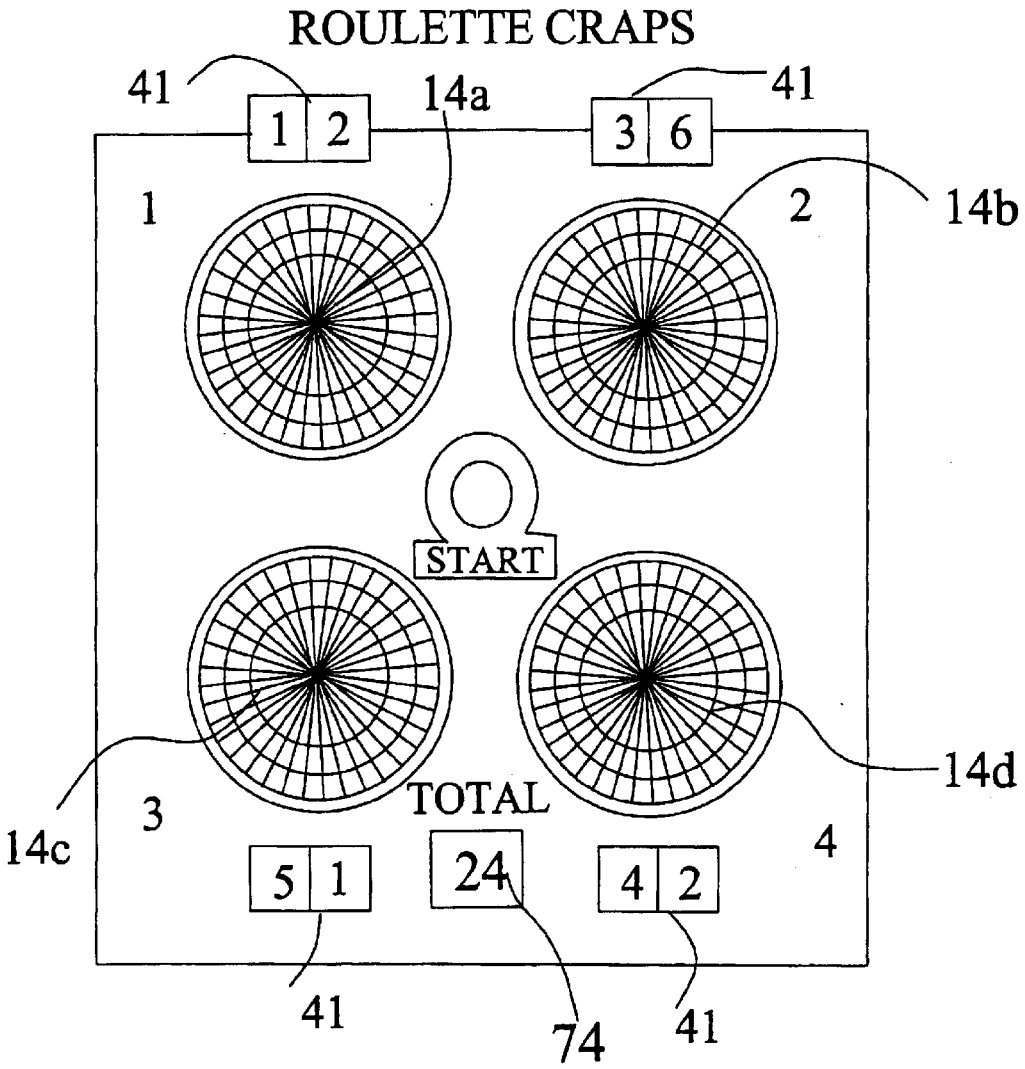
FIG. 14 is an alternate to FIG. 13 with four wheels.
Figure 14A:
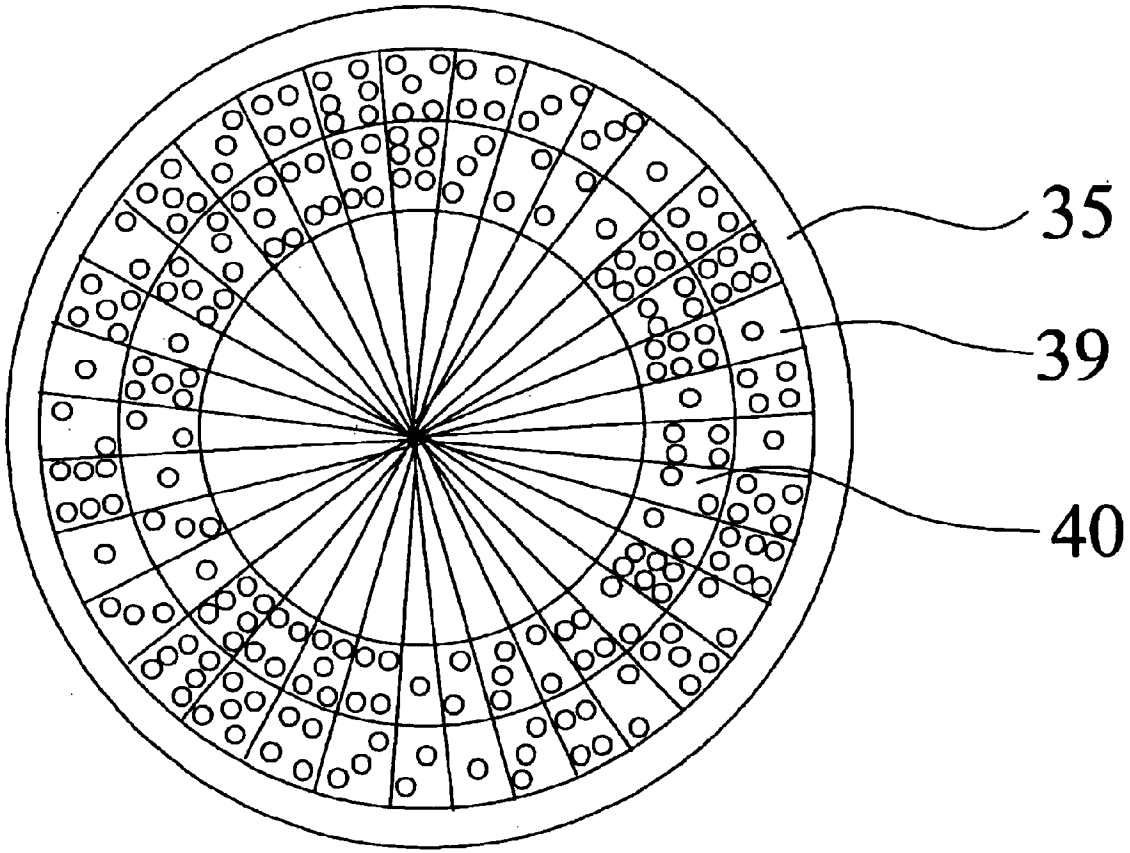
FIG. 14*a* is a detail view of item "FIG. 14*a*" shown in FIG. 14.
Figure 14B:
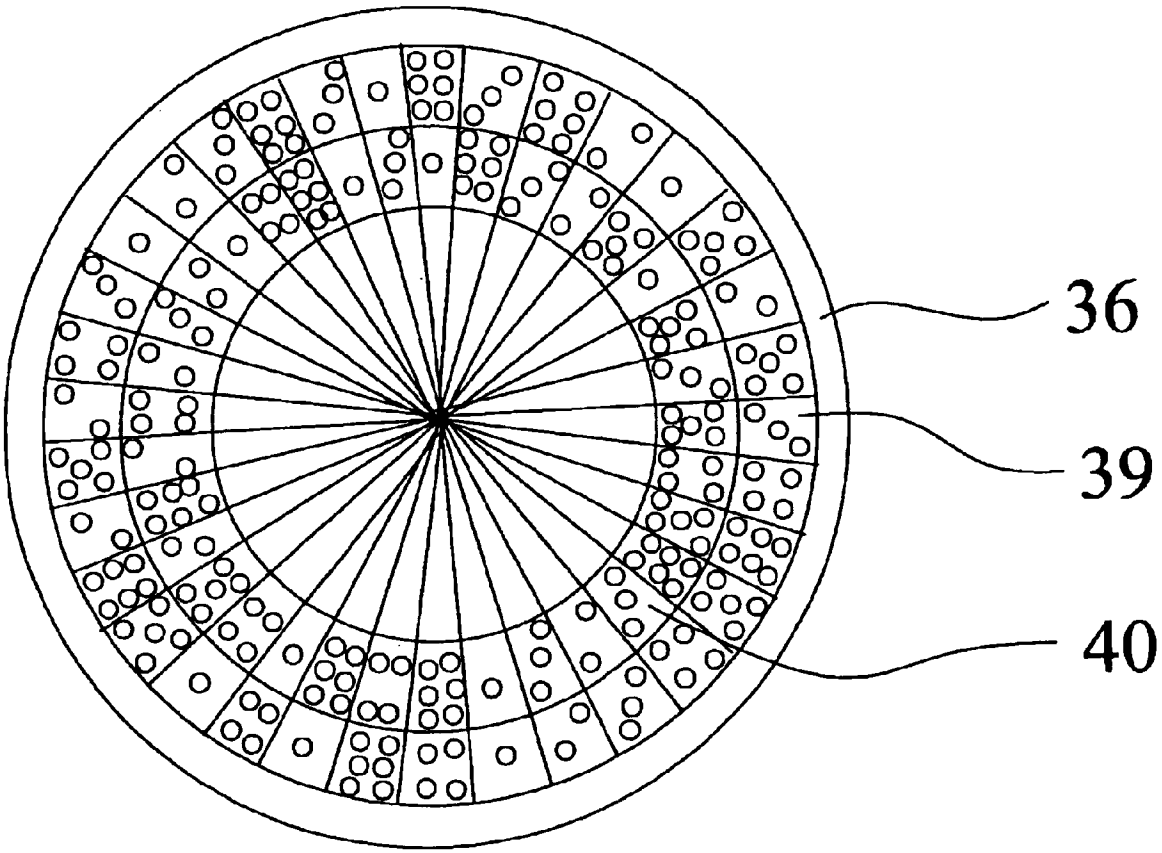
FIG. 14*b* is a detail view of item "FIG. 14*b*" shown in FIG. 14.
Figure 14C:
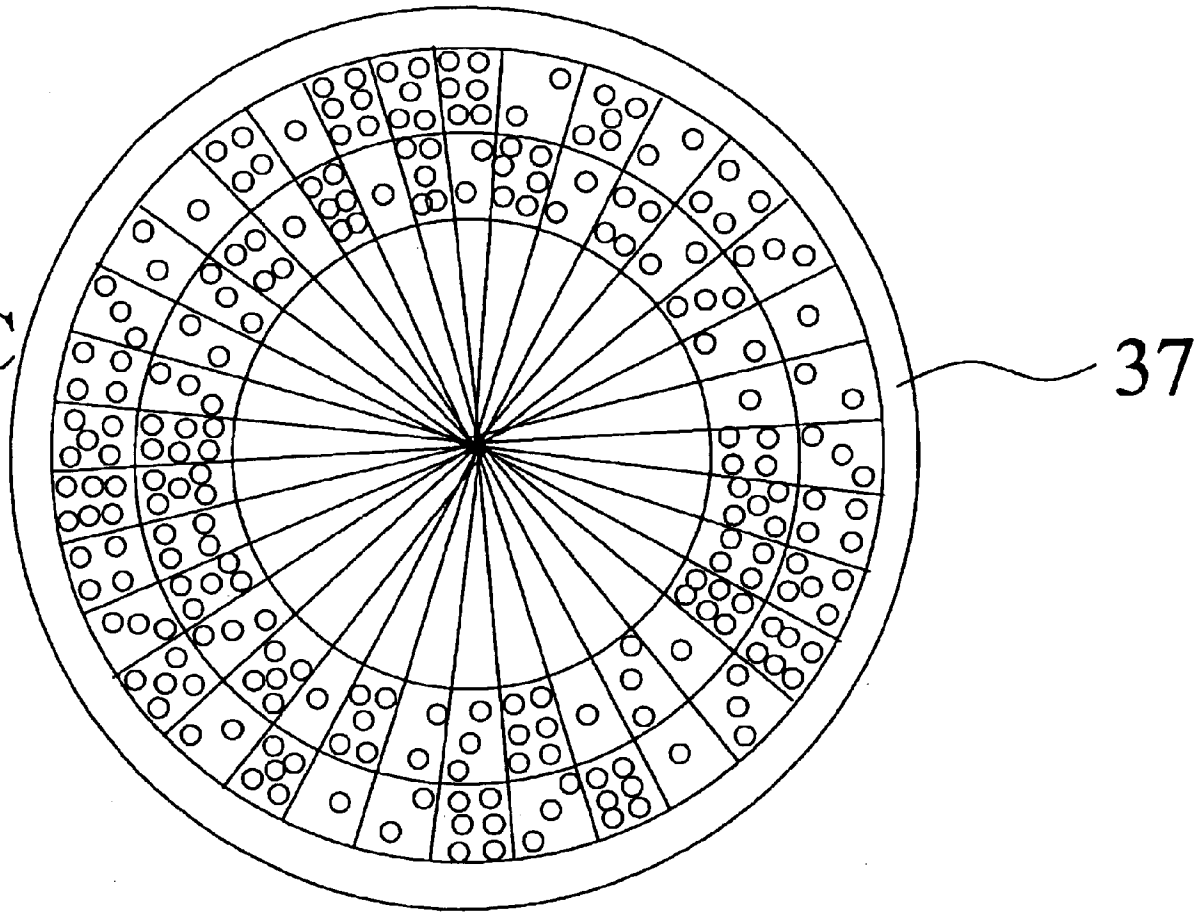
FIG. 14*c* is a detail view of item "FIG. 14*c*" shown in FIG. 14.
Figure 14D:
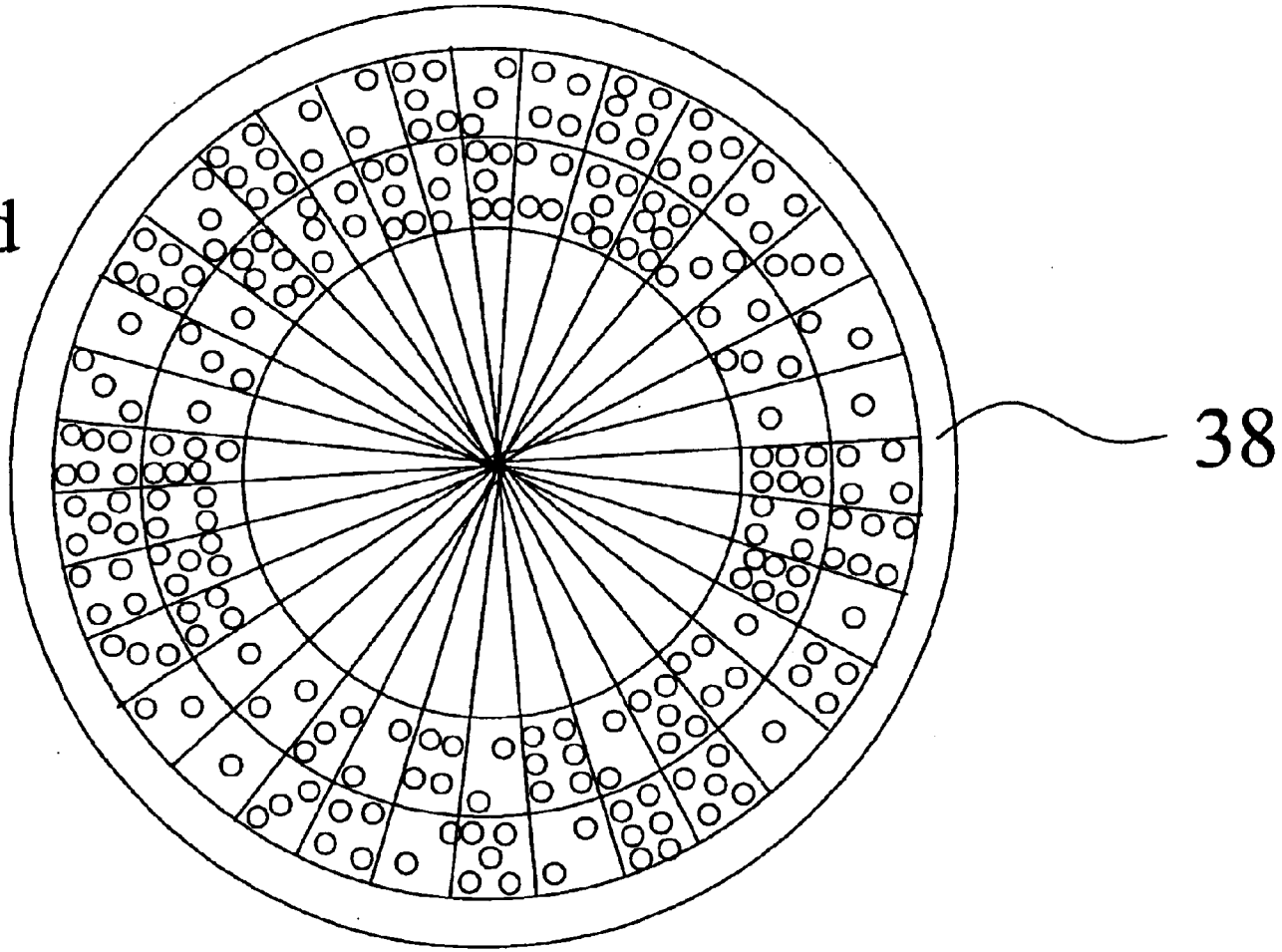
FIG. 14*d* is a detail view of item "FIG. 14*d*" shown in FIG. 14.

As shown in FIG. 14 one modification of four count dice game would be to provide for four spinning wheels 36, 36, 37 and 38 in place of dice or traditional slot columns (see 101–104 in FIG. 7). In this embodiment play is the same as with either four dice rolls or with four displays 101–104. The spinning wheels could have symbols (having 36 combinations if two six sided dice are the patterned number generator), numbers or, as shown here, dice dots displayed. Here 36 possible combinations are shown without special characters (see 50 in FIG. 3). Special characters 50 could be included by adding an extra column or replacing or adding the special characters to a numeric display. An inside row 40 and outside row 39 of numbers is used here. A novel case of the two number wheels would be to have inside and outside numbers move separately or in opposite directions to provide a more exciting display.

These wheels 35–38 may be real wheels or electronic displays. In the embodiment shown in FIG. 14, there numeric displays 41 for each result. 41(*a*) for example displays, electronically or mechanically, that the result for wheel 35 is one and two (for a total of three) for the top left wheel 35. The top right wheel 36 is three and six for a total of nine. A tally location 74 is displayed for all of the points (or all rolls) (7 is displayed if 7 is a target number). Here the tally location 74 shows 24 to be the total.

Figure 15:
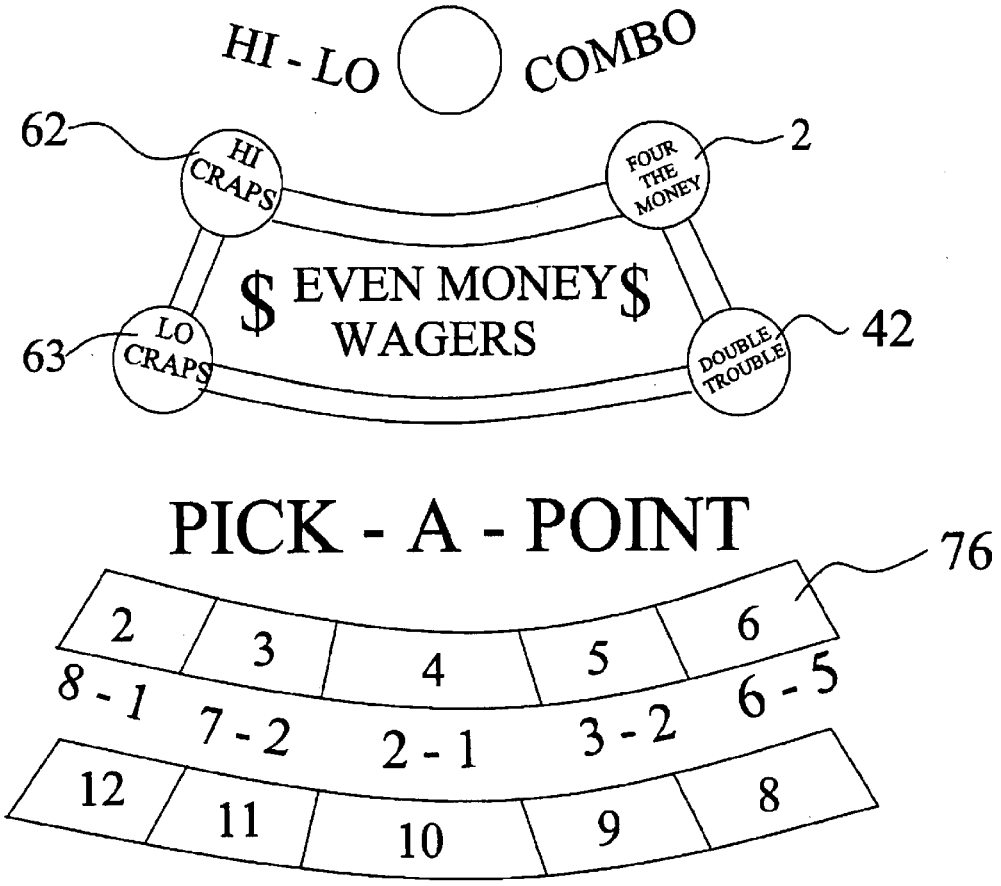
FIG. 15 shows a wager layout.

One person's wager location is shown in FIG. 15.

This shows a hi-craps location 62 a low craps location 63, a Four The Money wager location 2 and a double's wager location, "Doubles Trouble" 42 which is a wager that on any given spin a double will be displayed. In this embodiment a pick a point wager would be to pick one number per spin in the preferred embodiment.

Figure 12:
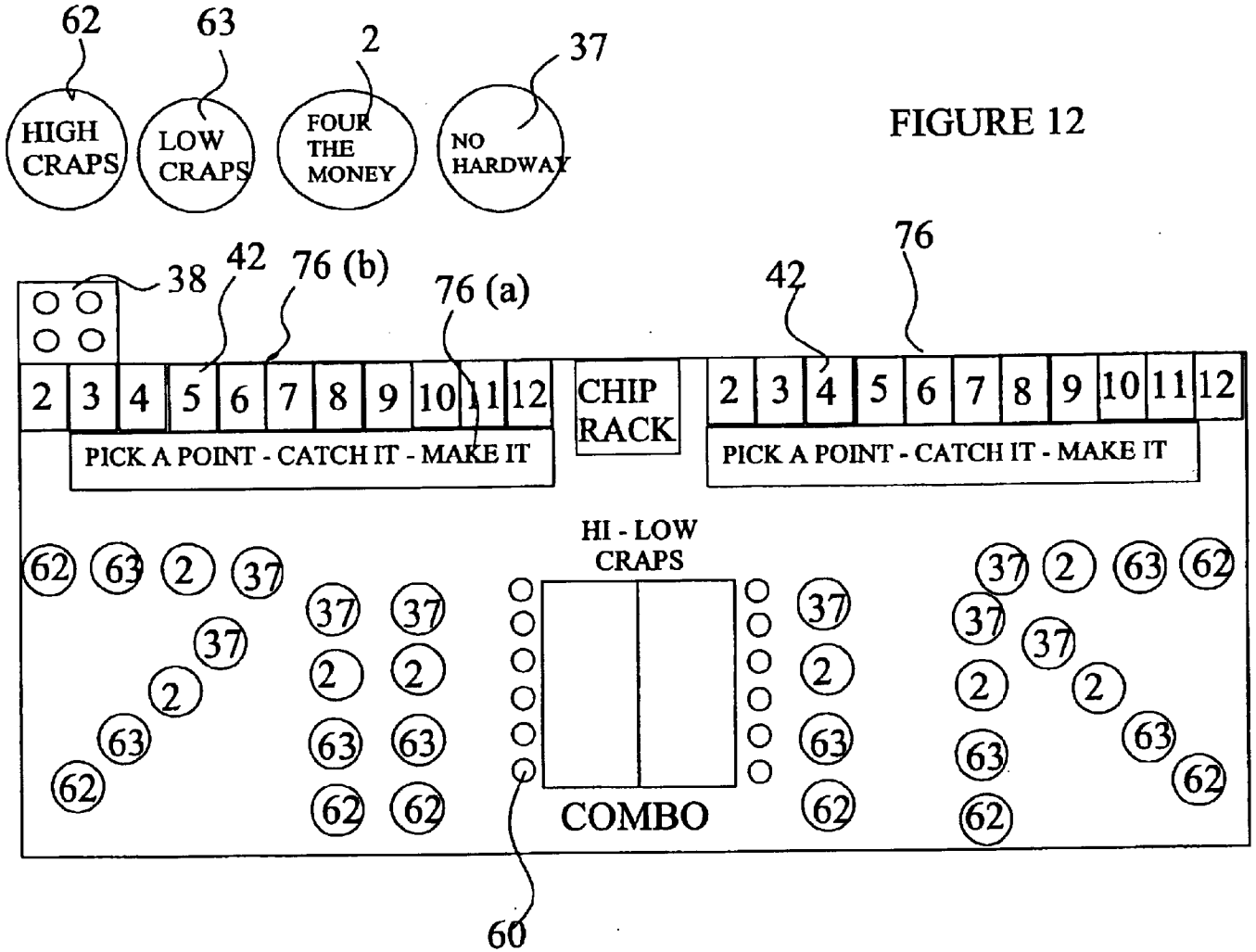
FIG. 12 shows an alternate table layout.

In this example, there is also a location to make a pick a point wager location 76 (see FIGS. 6*a* and 9). This wager may be played where the player picks a number which must be rolled twice before a payout is made. On the game, there would be a first wager location to show where the number was wagered. There would be a first display where the number was displayed when first generated before a termination event. There would be a second display where the number was displayed for a payout when the number was generated a second time as shown FIG. 12. Since in a continuous play game, this wager could occur twice, before won on a single number (once when first placed and the second time after the number was made the first time), a second wager location for the pick a point may be provide.

The wagers in this game for a high wager could vary depending on the number of points without a target number. For example reasonable pay outs would be:

48 points 10,000 to 1

45 points or more 1000 to 1

42 points or more 40 to 1

39 points or more 9 to 1

36 points or more 3 to 1

Whether a 7 is rolled or not.

For low totals, reasonable pay outs would be, for example:

8 points 10,000 to 1

11 points or less 1000 to 1

14 points or less 40 to 1

17 points or less 9 to 1

20 points or less 3 to 1

Seven's may be included in arriving at the total (in the preferred embodiment) or may cause an automatic loss as a target number.

Using this scenario, 21 to 35 would be a no pay total.

Other wagers on average number of doubles could also be provided as discussed in the prior embodiments. The high pay outs here (10,000 to 1) are based on four doubles (12's or 2's)

One embodiment of the invention disclosed herein utilizes multiple spinning reels in place of dice rolls. Every spinning wheel may display the 36 combinations possible with a single dice roll where two 6 sided dice are used. In order to provide for jackpots, an additional location may be provided so that when one or a group of spinning wheels showed the jackpot character, an enhanced payoff could be possible. (This could also be used in order to change the statistical odds in a fashion which is shown with a zero and a double zero in a roulette game.).

Where the inside 40 and outside reels 39 spin independently each can have only six numbers since these will represent 2 dice coming to a total independently.

Figure 13:
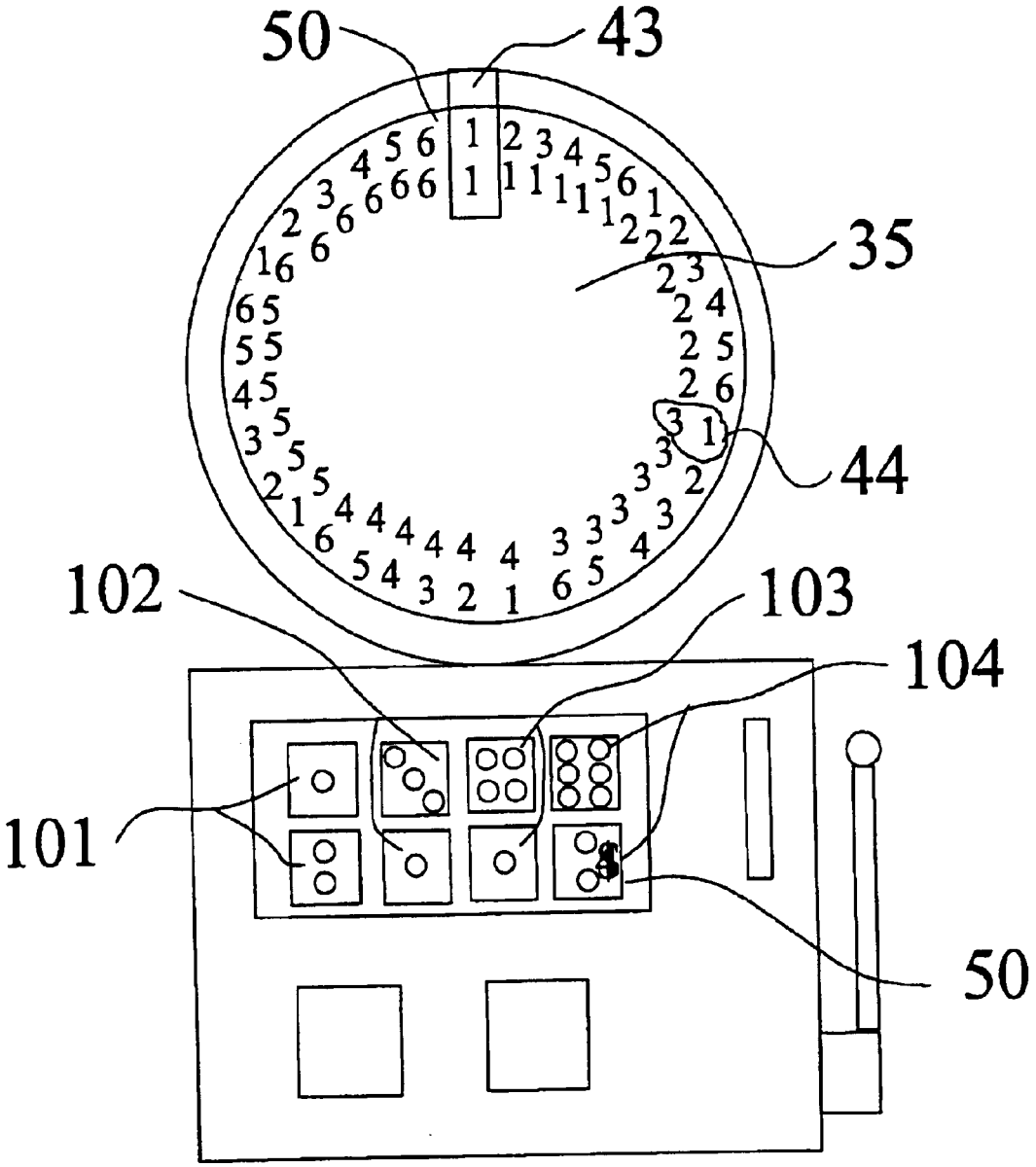
FIG. 13 shows a spinning wheel added to a slot display.

FIG. 13 shows where one (or more) spinning wheel 35 has been added to (or substituted for) the four displays 101, 102, 103 and 104 on slot or video displays.

The purpose of one or more spinning wheels may be to add excitement and give players more information. While one wheel is shown in FIG. 13, the four wheels shown in FIG. 14 or any lesser number may be used. The use of a wheel may be in addition to or as a substitute for one of the roles.

The wheel 35 may substitute for a roll and may be triggered by a triggering event. Examples of triggering events include: (a) the failure to display one or more target numbers or (b) the generation of one or more triggering events from a group comprising: (I) one or more doubles, (ii) a special character 50 with or in addition to a roll number, (iii) one or more wins or bonus wins as defined by the rules of the game or the like.

A set dollar payout may be associated with one or more numbers generated on the wheel 35 or the amount generated may be a function of it's effect on the rules of the game. This function may be to continue the payout or to be a multiple of the payout.

By way of example, in the Four the Money game, the rules pay two to one if a two or ten is generated (and selected). The payout may vary greatly. For example, if the number is the same on the wheel as another number generated it may be a 1 to 1 payment. It may have a 100 to one pay out if the special character 50 is displayed. The payout may be, by way of example, two times the bet on the front line or ten times that amount if the number has an independent wager.

Two views of one example would be as follows: (A) a two dollar odds wager on the ten and a one dollar wager on Four The Money wager. If a ten is generated, a $40.00 payout (10 times the regular payout) is made if the wheel lands on ten. The wheel may be spun in all cases in this example or only if a triggering even (see above for examples) occurs or only if a triggering event (e.g. A 7 in the roles 101–104) does not occur.

(B) a one dollar wager on the Four The Money and no odds wager on ten: A $2.00 payout or no payout may be paid if the spinning wheel lands on 10.

As can be seen, these are only exemplary. The payout from the wheel may be based on statistical chances and the wheel's motion may be statistically weighted to increase the payment odds. The odds may be varied for doubles 5-5, in the example, compared to non-doubles 4-6 or 6-4 in this example.

As shown in FIG. 13 or 14, the wheel (or wheels) may spin and where it (they) stop spinning may be based on a variety factors. In one example 3 wheels will spin while one is allowed to stop and pay outs made, then the stopped wheel could be caused to spin and the next wheel stopped. This would allow for one or more wheels to be used and stopped and started as desired and allow for more continuous play.

In FIG. 13 the number selected is in accord with a selection pointer, or selection window 43.

Figure 16:
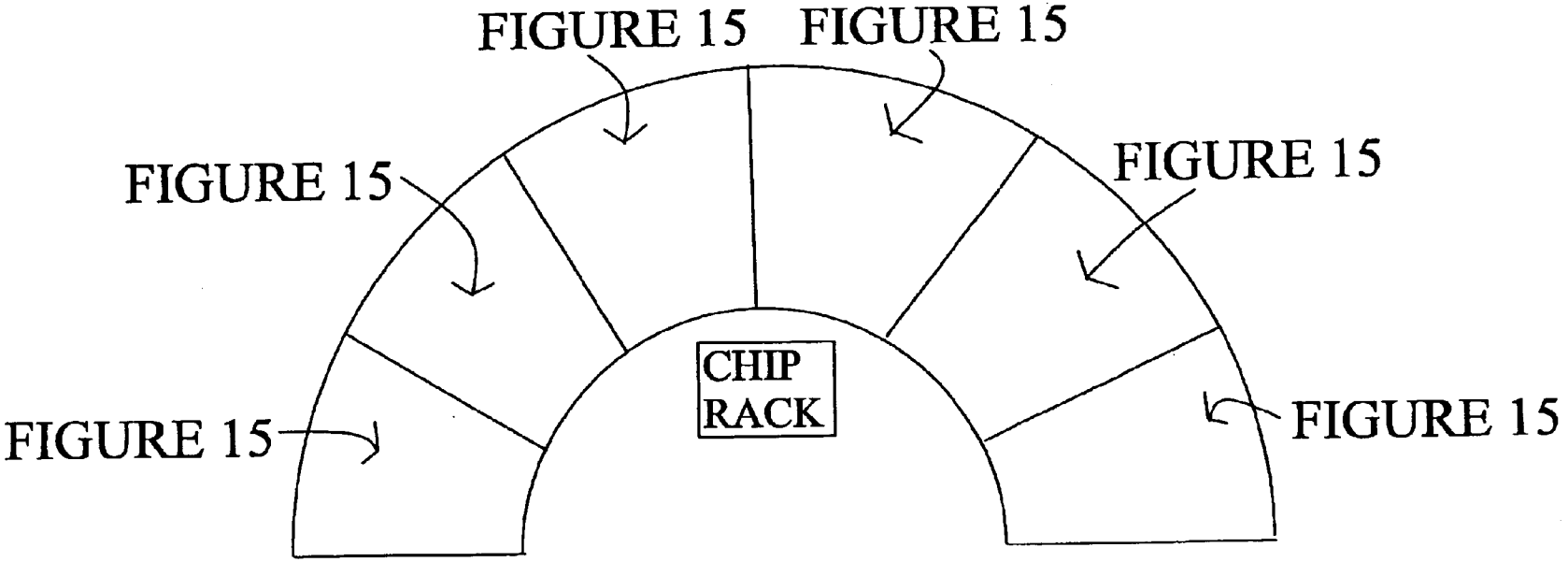
FIG. 16 shows a table for layouts shown in FIG. 15.

FIG. 15 shows a layout which could be used to place wagers whether on a slot machine or table layout. FIG. 16 shows how a number of the layouts shown in FIG. 15 could be arranged at a table.

The odds shown for payouts are not true odds (12 on 4 wheels would have true odds of 1,679,616 to one).

If any four doubles, same total of points gives a free spin. If each came up as an 8 and wheel on 8 hut would be a match win, if they all added to 4 and the wheel was a 4 that would be a win. The payment on the match win would increase with the statistical odds against the match.

Some win, even a large a small one, would be tied to any other appearing. This could also be based on the statistical odds if the single number appearing. A large multi million dollar jackpot could be based on all combos having a wild card 50 and the wild card for also coming up on the spinning wheels.

While wild cards 50 are used, they may be colored and the spin may be based on all of the colors matching and all of the colors being different here requiring 4 different colors).

The decision on how to write the payments can be based on pure statistics or may be otherwise controlled. Statistical determination using multiple dice rolls is discussed above, but this would have to be altered if special characters and larger jackpots were used which would change the results. However, significant payouts would be possible without changing from statistical odds.

For example, if the odds are for a the 7 showing on the 4 reels (101, 102, 103, and 104) and at a matching 7 or any other number coming on the spinning wheel, the true odds of the spinning wheel with the 47's on the other reels (12 95:1) would be 7775 to 1.

This is based on 5 to 1 with 4 to qualify for the spinning wheel. The spinning wheel odds the $5^{th}$ possibility. This would not be the payment, however even if it was an even money bet, because the payment in this example also must are into account payout using the outs on other winning combinations. There is, therefore an infinite number of payout combinations possible based on what statistics (doubles like totals wild cards, etc.) are selected and what payback (98%, 90%, etc.) is selected by the user.

This farther complicated by allowing other payout, just on the first 4 reels (for example using the odds for Four The Money on High-Low craps set out hereinabove. The benefit of this conceptually is to allow a huge variety to the player and casino alike according to rules which are generally well known (six sided dice statistics) and accepted.

Multi-Win Game

Another embodiment, viewable by reference to FIG. 13 is played where a customer pays a pay amount in a slot 46 for the right to play a slot machine a number of times by receiving credits corresponding to the pay amount (x dollars). The customer must play all these credits or the machine may automatically repeat itself tallying wins and losses until all of the credits are used. During the play the machine must be able to go negative as well as positive. By way of example, if it is a three coin $1.00 machine and the player plays three coins and doesn't win anything, the machine has to register a negative 3. If the player won ten coins, the machine would have to register a positive 7. This would be 10 coins won minus 3 coins played equal to a plus seven (+7). This could be displayed at a cumulative win location 77. One unique part of the idea is the ability of the machine to go negative and keep track of the net cumulative score. The credits remaining to the player and size of the wager may be shown at a wager amount display 78 and credit amount display 79 respectively.

This may be done with a card where the player would purchase a card. It would be utilized on a machine with a set statistical payout. A set amount would have to be wagered. The number of plays would depend on the alteration of the statistical odds associated with the card in question. After all of the plays were used up, any credit remaining on the card would be credited to the user in whole or in part. For example if a minimum of 50 plays was required and the net loss was 10 credits, the player might be awarded 10 credits or might be awarded a lesser number of credits (such as 5). The card would be able to track loses as opposed to wins. In this embodiment, the card could be used by the user for several purposes: (1) to offset the statistical odds within the machine, (2) to track the wins and losses of the player for tax and other purposes or (3) to provide for promotional benefits that could follow the card and be used at several locations as opposed to a player card with a single location.

Figure 17:
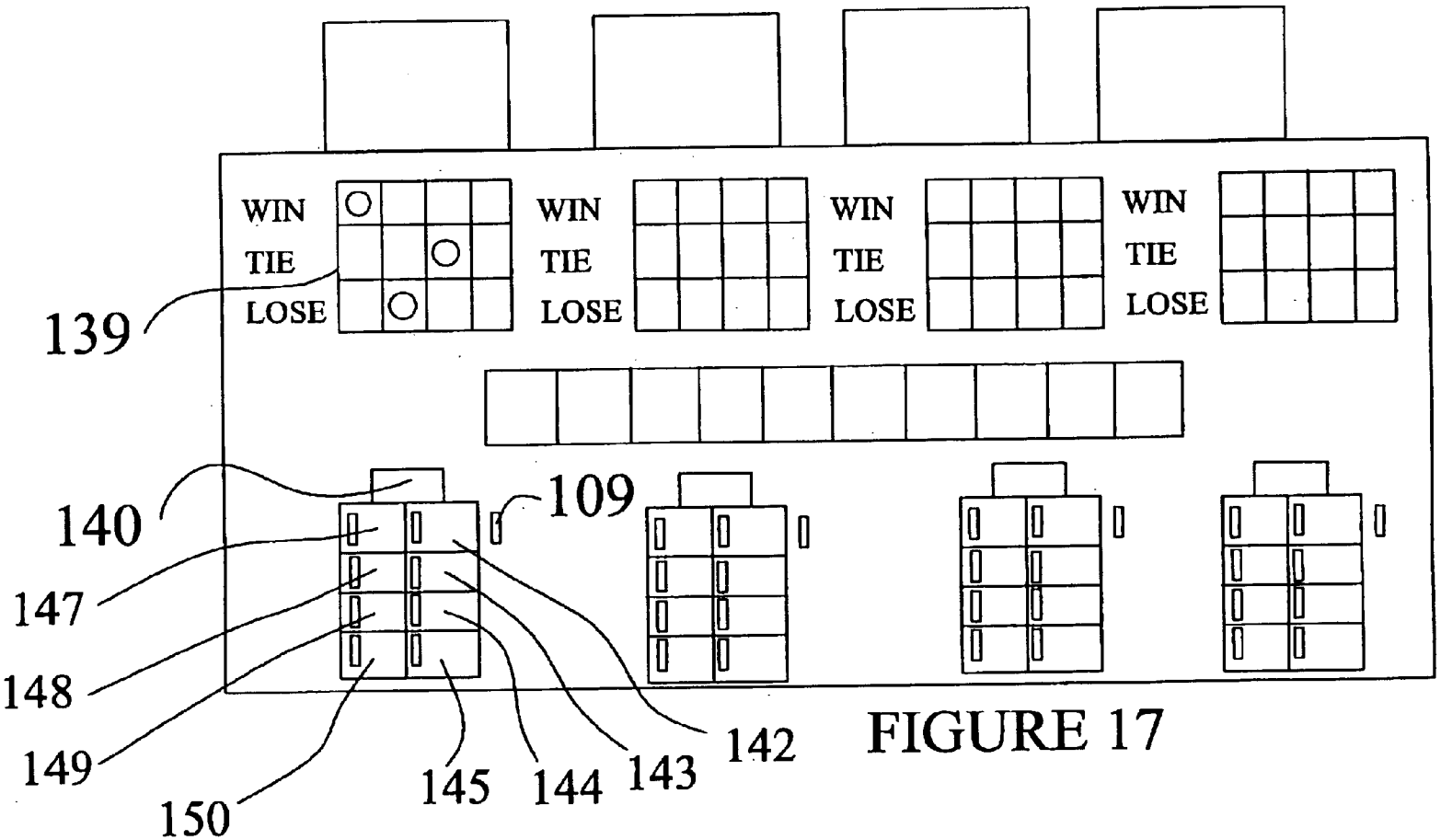
FIG. 17 shows a gaming table layout for the invention.

The invention in an alternative embodiment shown in FIG. 17 comprises a gaming table on which a game of chance is played.

Before each player is a counter 139 which increases in number every time a hand is won or which reflects the wins, ties and losses. (Hand is liberally used here to refer to a determining event.)

The player may make a wager on the number of wins in a row on his hand or in an alternate embodiment on any other hand or may make a wager on a specific number of wins in a series (3 of 4, for example).

A second counter may allow the player to wager that the number of points will be either over a certain number, under a certain number or between a certain number during a given number of hands or rolls.

As described above this same concept may be embodied in a slot machine utilizing craps, dice or various card games.

The game may be described as a betting game wherein the player wagers that he will get either (1) a certain number of wins in a row or (2) a certain number of points based on numbers assigned to the cards or to the dice prior to losing or (3) a certain number of wins out of a total. This allows a player to wager that he will win a certain number of hands or a certain number of points in a series.

The statistical payout is arranged in order to insure that a wager when placed will not have a better chance of winning than the chance of losing and will also be designed so as not to be used to offset the main wager in a prejudicial format to the house.

There are several methods of playing this wager. The best is to allow the player to make this wager electronically so that a video machine or slot machine automatically tracks the wager and count.

The wager may be (1) a certain number of wins in a row (2) a certain number of wins in a certain number of plays or (3) a certain number of wins in a given time (this last wager is difficult because it requires speed). One problem with the second two wagers is that it requires that the player remain and play or forfeit the wager.

One way to avoid this, is to allow the player to make or bet on multiple wagers at once.

For example, if the player was at a Four the Money or craps table he could wager what the first three numbers would be and all three numbers would be labeled with a number marker numbered one through three. Here, a first marker (electronic or physical) is on the first wager, the second marker on the second wager and the third marker on the third wager. The wager could have a higher payout if the 3 points occurred in order.

While this could work well electronically if players were able to make this wager at each opportunity, it would be labor intensive if not electronically tracked.

The play in FIG. 17 occurs at a slot location 142–150 for each number. The payout could order the numbers by the timing of the token or wager being put in the slot.

A counting of wins (1-4 for example, or 3 of 5 for a number of wins within a number of tries) is shown for each occurrence of the wager made. This display may also show the amount of the wager ($1, $5, etc.).

The player in this case may have wins of different sizes and the wins are recorded as they occur at the win display 139. Here the pay outs are totaled at total location 140 until the player cashes out. Ties may also be the subject of the wager since the display 139 shows wins, losses and ties in this embodiment. Even if the primary wager is forfeited, the amounts to the point where play is discontinued may be paid. Several wagers are made at once at wager locations 142–150.

FIG. 17 shows the tracking of wins of several players at a table. In front of each player is a wager location 142 through 145. Beside each wager location 142 through 145 is a number of wins wager location 147 through 150. Here it is envisioned each player would note one such wager at a time.

A tracking location win display 139 in front of each player allows wins to be counted. Losses may also be shown the same way.

Here, each player makes a certain number of bets at one time (here up to 4). Beside is a location 109 where the player wagers he will win the next four wagers (or a certain number of the totals.

In the all win version if a single wager were lost, the player would lose his side wager 109.

FIG. 17 shows where the count is maintained for each player by a counter 139 and a pay out display 140 showing the amount won up to the point in time. This layout may allow a player to keep his wins (as shown at the display 140) at risk or to quit and cash out before the next play of hands or other determining event (roll of dice or roulette).

An alternative approach would be to allow a player to wager all the players (here up to 4, but it could be more) will win against a single dealer. This version would be limited by the number of hands a single player wagered at one time and by the number of players playing at one time. The payout (true odds) of winning would pay 3 to 1 for 2 players; 3 players 7 to 1; 4 players 15 to 1; 5 players 31 to 1 or 6 players 53 to 1. Here the more players in a given hand, the more to be won.

While wins are counted here, the house could also count specific events (face cards, doubles, etc.).

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

We claim:

1. A method for a player playing a dice related casino game using two six sided dice for determining an outcome comprising the steps of:

a) providing a table means for accepting and tracking wagers comprising a plurality of first wager locations b) providing a first wheel means for displaying a first result from the possible results corresponding to at least all of the results from two six sided dice;

c) providing at least one second wheel means for displaying at least one second result from the possible results corresponding to at least all of the results from two six sided dice;

d) placing at least one wager;

e) generating the first result from the first wheel means;

f) settling the at least one wager;

g) generating the at least one second result from the at least one second wheel means;

h) repeating step f; and i) repeating steps a–h until play is terminated.

2. The method of claim 1 wherein the step of settling the at least one wager comprises the steps of designating the at least one wager as a winning wager or a losing wager or a wager which is neither a winning or losing wager and removing the at least one wager if the at least one wager is a losing wagers from the table means or paying the at least one wager if the at least one wager is a winning wager.

3. The method of claim 2 wherein the table means further comprises tracking wager locations and wherein the the step of settling the at least one wager further comprises the step of moving at least one wager to the tracking wager location if the at least one wager is not a winning wager or a losing wager.

4. The method of claim 1 wherein the table means is a table layout for playing a traditional dice game.

5. The method of claim 4 wherein the table layout is a craps table layout.

6. The method of claim 4 wherein the table layout is a four the money layout.

7. The method of claim 1 wherein the method further comprises a counting and the table means further comprises providing a counting wager location which allows the player to win the counting wager if a specified result is obtained on the first wheel means and at least one second wheel means.

8. The method of claim 7 wherein the counter wager further comprises at least one target number from the possible results and wherein the specified result is a number of M results other than the at least one target number on the first wheel means and at least one second wheel means and wherein the number M corresponds to the total number of wheels.

9. The method of claim 8 wherein there are four wheel means.

10. The method of claim 9 wherein the target number is 7 and wherein the two six sided dice are numbered 1 to six.

11. The method of claim 1 wherein the first wheel means comprises a spindle, a wheel rotationally mounted onto the spindle, said wheel defining a center and a face extending out from the center and wherein the face further comprises a perimeter and markings along the perimeter corresponding to the possible results and further comprising a marker for displaying the first result.

12. The method of claim 11 wherein the at least one second wheel means comprises a spindle, a wheel rotationally mounted onto the spindle, said wheel defining a center and a face extending out from the center and wherein the face further comprises a perimeter and markings along the perimeter corresponding to the possible results and further comprising a marker for displaying the at least one second result.

13. The method of claim 12 wherein the method further comprises spinning the wheel means sequentially from one to next until the game is terminated.

14. The method of claim 1 wherein the first wheel means comprises a first dice means for displaying the results of a first six sided dice and a second dice means for displaying the results of a second six sided dice and wherein the at least one second wheel means comprises a second dice means for displaying the results of a first six sided dice and a second dice means for displaying the results of a second six sided dice.

* * * * *